US005200784A

United States Patent [19]

Kimura et al.

[11] Patent Number: 5,200,784

[45] Date of Patent: Apr. 6, 1993

[54] TRANSFERRING DEVICE CONTROLLED FOR PREVENTING THE LEADING EDGE OF A SHEET FROM BEING EXCESSIVELY CHARGED

[75] Inventors: Masatoshi Kimura, Ebina; Sachio Sasaki, Yokohama; Hideaki Iwasaki, Kawasaki; Kunihiko Sato, Zama; Masao Konishi, Hachioji; Akiyoshi Iwamasa, Ebina; Toshio Tooda, Kawasaki; Hiroshi Nou, Yokohama; Shigenobu Utaka, Kawasaki; Ryo Kitao, Yokohama, all of Japan

[73] Assignee: Fujitsu Limited, Japan

[21] Appl. No.: 774,377

[22] Filed: Oct. 10, 1991

Related U.S. Application Data

[63] Continuation of Ser. No. 483,691, Feb. 23, 1990.

[30] Foreign Application Priority Data

| | | | |
|---|---|---|---|
| Feb. 25, 1989 | [JP] | Japan | 1-44367 |
| Feb. 25, 1989 | [JP] | Japan | 1-44368 |
| Feb. 25, 1989 | [JP] | Japan | 1-44369 |

[51] Int. Cl.[5] ..... G03G 15/16

[52] U.S. Cl. ..... 355/274; 355/271; 355/315

[58] Field of Search ..... 355/273, 274, 276, 315, 355/271; 271/900; 361/229, 235, 214

[56] References Cited

U.S. PATENT DOCUMENTS

| | | | |
|---|---|---|---|
| 3,970,381 | 7/1976 | Meagher et al. | 355/315 |
| 4,027,960 | 6/1977 | Ladrigan | 355/274 |
| 4,055,380 | 10/1977 | Borostyan | 355/274 X |
| 4,190,348 | 2/1980 | Friday | 355/274 |
| 4,286,862 | 9/1981 | Akita et al. | 355/315 |
| 4,896,192 | 1/1990 | Kinoshita | 355/315 |
| 5,012,293 | 4/1991 | Aldrich et al. | 355/274 |

FOREIGN PATENT DOCUMENTS

| | | | |
|---|---|---|---|
| 0089430 | 8/1978 | Japan | 355/315 |
| 0062465 | 5/1980 | Japan | 355/315 |
| 0156077 | 7/1986 | Japan | 355/315 |

*Primary Examiner*—A. T. Grimley
*Assistant Examiner*—Nestor R. Ramirez
*Attorney, Agent, or Firm*—Nikaido, Marmelstein, Murray & Oram

[57] ABSTRACT

A toner image transferring device is applied to, for example, an electrophotographic printer for electrostatically transferring a charged toner image from a photosensitive drum to a sheet or paper. The device encompasses a transfer charger disposed near the drum to form a clearance therebetween for feeding an electric charge to the sheet or paper through which the sheet or paper is passed, an electric source for supplying an electric energy to the transfer charger to give the sheet or paper an electric charge having a polarity opposite to that of the charge of the toner image, and a controller for controlling the electric energy output from the electric source the transfer charger so that a leading edge of the sheet or paper can be prevented from being excessively charged.

6 Claims, 19 Drawing Sheets

| Fig. 9A | Fig. 9B |
|---|---|

| Fig. 13A | Fig. 13B |
|---|---|

| Fig. 18A | Fig. 18B |
|---|---|

Fig. 20(a)
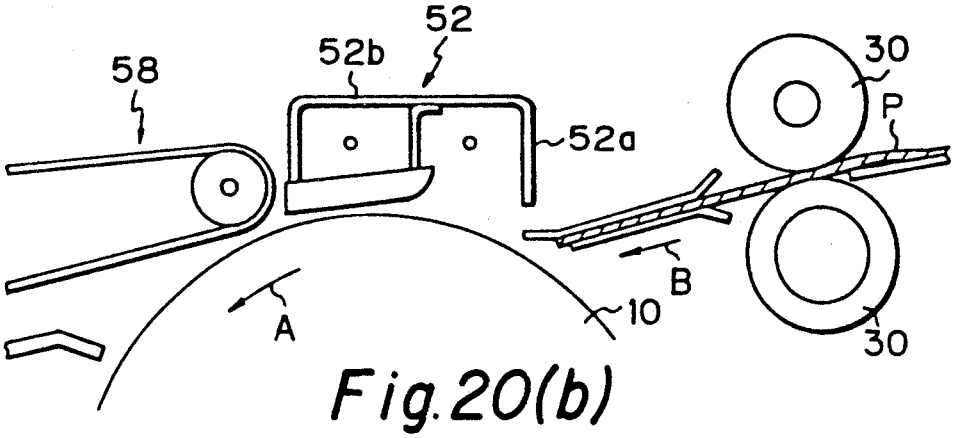
Fig. 20(b)
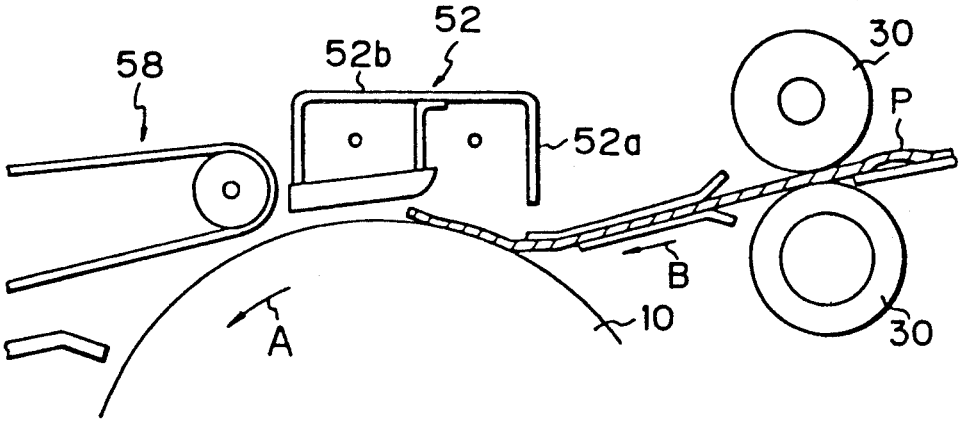
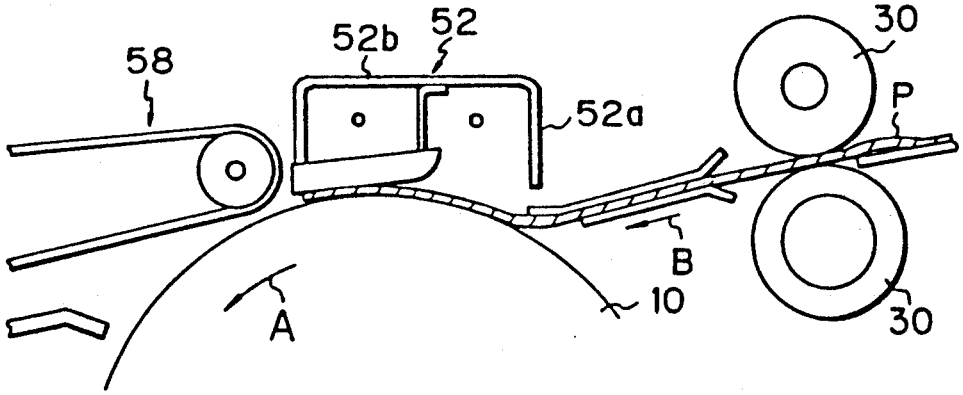
Fig. 20(c)

TRANSFERRING DEVICE CONTROLLED FOR PREVENTING THE LEADING EDGE OF A SHEET FROM BEING EXCESSIVELY CHARGED

This application is a continuation of application Ser. No. 483,691 filed Feb. 23, 1990.

BACKGROUND OF THE INVENTION

1) Field of the Invention

The present invention generally relates to an electrophotographic printer including a toner image carrying body such as a photosensitive drum, a dielectric drum or the like to which a toner image obtained from a toner development of an electrostatic latent image is electrostatically adhered and held, and in particular, relates to a toner image transferring device incorporated therein for electrostatically transferring the toner image from the toner image carrying body to a sheet or paper.

2) Description of the Related Art

As is well known, the electrophotographic printer typically carries out the processes of: producing a uniform distribution of electrical charges on a surface of a rotary photosensitive drum; forming an electrostatic latent image on the electrically charged surface of the photosensitive drum by optically writing an image thereon with a laser beam scanner, an LED (light emitting diode) array, an LCS (liquid crystal shutter) array or the like; visually developing the electrostatic latent image with a developer, i.e. toner, which is electrically charged to be electrostatically adhered to the electrostatic latent image zone; electrostatically transferring the developed visible image or toner image from the drum to a sheet or paper; and fixing the transferred image on the sheet or paper.

In the transferring process, the transfer of the toner image to the paper is carried out by using a transfer charger to feed an electric charge to the paper.

Namely, the transfer charger is disposed in the vicinity of the photosensitive drum, the paper is introduced into a clearance therebetween, and the transfer charger gives the paper an electric charge having a polarity opposite to that of the electric charge of the toner image, whereby the toner image is electrostatically transferred from the drum to the sheet or paper. Note, the transfer charger may be a corona discharger.

To increase the efficiency of the transfer of the toner image, the paper must be given an amount of electric charge on the order of about 320 $\mu$ C/m$^2$, and thus the transfer charger is provided with a capacity needed to give the paper such an amount of electric charge. Nevertheless, in practice, leading and trailing edge portions of the paper have a large amount of electric charge of much more than 320 $\mu$ C/m$^2$ because, when the paper is not intervened between the transfer charger and the photosensitive drum, the charge is given to the drum as a body to be charged. In particular, the photosensitive drum has an electric capacity of about 5 $\mu$ F/m$^2$, which is larger than that (about 0.5 $\mu$ F/m$^2$) of the paper, so that an amount of electric charge fed from the transfer charger to the drum is relatively large when the paper is not intervened therebetween. As a result, when the leading edge of the paper is introduced into the clearance between the transfer charger and the drum, or when the trailing edge thereof leaves therefrom, a portion of the electric charge to be fed to the drum is added to the leading or trailing edge portion of the paper.

When the leading edge portion of the paper is given a large amount of electric charge, it will be strongly adhered to the photosensitive drum due to an electrostatic attraction acting therebetween, and thus the paper is often entangled with the drum. Therefore, conventionally, for example, a pair of nail members are engaged with a surface of the photosensitive drum at the side edges thereof, to separate the leading edge of the paper therefrom and prevent the entanglement of the paper with the drum. Nevertheless, the entanglement of the paper may frequently occur because the pair of nail members are merely applied to the side edges of the paper, and thus the separation of the paper from the photosensitive drum is not effectively carried out in practice. When the nail members are engaged with the photosensitive drum surface at the middle position thereof, to carry out an effective separation of the paper from the drum, they are applied to a middle area of the paper on which the toner image has been transferred, and thus the transferred toner image can be damaged by the nail members.

It is also known that an AC charger eliminator, which may be a corona discharger, is disposed adjacent to the transfer charger, to partially eliminate the electric charge from the paper to which the toner image has been transferred, whereby the electrostatic attraction between the paper and the photosensitive drum can be weakened. Nevertheless, the leading edge of the paper cannot be effectively separated from the photosensitive drum due to the excessive charge thereof. Of course, an AC charge eliminator may be arranged so that the electric charge can be eliminated from the leading edge of the paper, but in this case, the toner image may be returned from the paper to the photosensitive drum.

SUMMARY OF THE INVENTION

Therefore, an object of the present invention is to provide a toner image transferring device for electrostatically transferring a charged toner image, which is electrostatically held by a toner image carrying body, therefrom to a sheet or paper, wherein only a leading edge of the sheet or paper can be effectively prevented from being excessively charged, so that a separation of the leading edge of the sheet or paper from said toner image carrying body can be facilitated.

In accordance with the present invention, there is provided to a toner image transferring device for electrostatically transferring a charged toner image, which is electrostatically held by a toner image carrying body, therefrom to a sheet or paper, which comprises: transfer charger means disposed in the vicinity of said toner image carrying body to form a clearance therebetween for feeding an electric charge to the sheet or paper through which the sheet or paper is passed; electric source means for supplying an electric energy to the transfer charger means so as to give the sheet or paper an electric charge having a polarity opposite to that of the charge of the toner image; and means for controlling the electric energy output from the electric source means the transfer charger means in such a manner that the transfer charger means gives the sheet or paper an amount of electric charge necessary for the transfer of the toner image only when the sheet or paper is completely intervened between the toner image carrying body and the transfer charger means during the passage of the sheet or paper through the clearance therebetween, whereby the leading edge of the sheet or paper can be prevented from being excessively charged.

In the present invention, the controlling means may control the electric energy output from the electric source means to the transfer charger means in such a manner that the transfer charger means gives the sheet or paper a first amount of electric charge necessary for the transfer of the toner image only when the sheet or paper is completely intervened between the toner image carrying body and the transfer charger means during the passage of the sheet or paper through the clearance therebetween, and that the transfer charger means gives the sheet or paper a second amount of electric charge less than the first amount of the electric charge when the leading edge of the sheet or paper is intervened between the toner image carrying body and the transfer charger means during the passage of the sheet or paper through the clearance therebetween, whereby the leading edge of the sheet or paper can be prevented from being excessively charged. The electric source means may be a direct current source or a direct current voltage source. The toner image carrying body may be formed as an photosensitive drum which is rotated to bring the toner image to the transfer charger means. In this case, the toner image transferring device according to the present invention further comprises means for synchronizing the movement of the sheet or paper with the rotation of the photosensitive drum so that the toner image can be transferred from the photosensitive drum to the sheet or paper at a proper position thereon.

In accordance with another aspect of the present invention, there is provided a toner image transferring device for electrostatically transferring a charged toner image, which is electrostatically held by a toner image carrying body, therefrom to a sheet or paper, which comprises: transfer charger means disposed in the vicinity of the toner image carrying body to form a clearance therebetween for feeding an electric charge to the sheet or paper through which the sheet or paper is passed; alternate current charger eliminator means disposed adjacent an outlet of the clearance from which sheet or paper is discharged; first electric source means for supplying an electric energy to the transfer charger means so as to give the sheet or paper an electric charge having a polarity opposite to that of the charge of the toner image; second electric source means for supplying an electric energy to the alternate current charger eliminator means to eliminate a first amount of electric charge from the sheet or paper, when leaving from the clearance, so as to prevent the transferred toner image from being returned from the sheet or paper to the toner image carrying body; and means for controlling the electric energy output from the second electric source means to the alternate current charger eliminator means in such a manner that the alternate current charger eliminator means eliminates a second of electric charge more than the first amount of electric charge only from the leading edge of the sheet or paper, whereby a separation of the leading edge of the sheet or paper from the toner image carrying body is facilitated.

In this aspect of the present invention, the toner image transferring device may further comprise means for controlling the electric energy output from the first electric source means to the transfer charger means in such a manner that the transfer charger gives the sheet or paper a first amount of electric charge necessary for the transfer of the toner image only when the sheet or paper is completely intervened between the toner image carrying body and the transfer charger means during the passage of the sheet or paper through the clearance therebetween, and that the transfer charger means gives the sheet or paper a second amount of electric charge less than the first amount of the electric charge when the leading edge of the sheet or paper is intervened between the toner image carrying body and the transfer charger means during the passage of the sheet or paper through the clearance therebetween, whereby the leading edge of the sheet or paper is prevented from being excessively charged. Also, when the toner image carrying body is formed as a photosensitive drum which is rotated to bring the toner image to the transfer charger means, the toner image transferring device further comprises means for synchronizing the movement of the sheet or paper with the rotation of the photosensitive drum so that the toner image can be transferred from the photosensitive drum to the sheet or paper at a proper position thereon.

Furthermore, the means for controlling the electric energy output from the second electric source means to the alternate current charger eliminator means utilizes at least one of a peak-to-peak voltage and an offset voltage as a control parameter.

BRIEF DESCRIPTION OF THE DRAWINGS

Other objects and advantages of the present invention will be better understood from the following description, with reference to the accompanying drawings, in which:

FIG. 12(*b*) is a view explaining an offset voltage and peak-to-peak voltage of an alternate current;

FIGS. 20(*a*), 20(*b*), and 20(*c*) are views showing steps of the operation of the toner image transferring device of FIG. 17.

DESCRIPTION OF THE PREFERRED EMBODIMENTS

Figure 1:
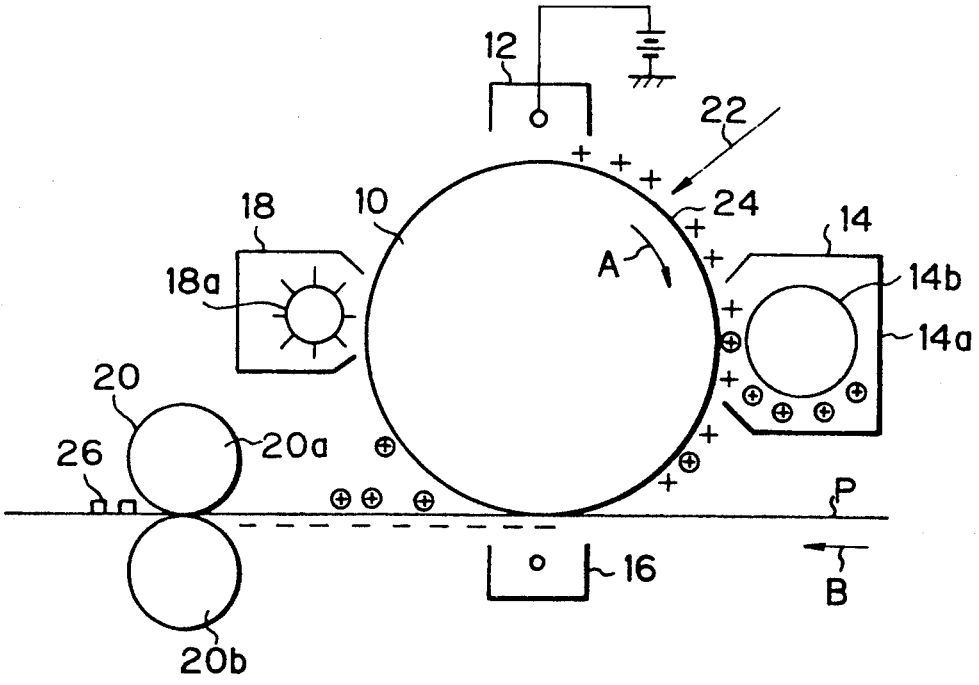
FIG. 1 is a schematic view of an electrophotographic printer to which a toner image transferring device according to the present invention be applied.

FIG. 1 shows an electrophotographic printer to which a toner image transferring device according to the present invention is applied. The electrophotographic printer includes a rotary photosensitive drum 10, as a toner image carrying body, which may be formed of an aluminum cylindrical hollow element and a photoconductive insulating film such as an amorphous silicone film (a-Si) bonded thereto. During operation, the drum 10 is rotated in a direction as indicated by an arrow A. The printer also includes a charger 12, a toner developing device 14, a transfer charger 16, and a cleaner 18, which are successively disposed around the photosensitive drum 10 in the direction of rotation thereof. A sheet or paper P is introduced into a clearance between the drum 10 and the transfer charger 16, in a direction as shown by an arrow B. The printer further includes a toner image fixing device 20 disposed downstream of the transfer charger 16 in the direction of travel of the paper P.

The charger 12 may comprise a corona discharger, which is arranged to give the positive charges (+) to the photoconductive insulating film of the photosensitive drum 10, so that a uniform distribution of the positive charges (+) is produced on the drum surface, as shown in FIG. 1. The electrophotographic printer is provided with an optical writing means such as a laser beam scanner, an LED (light emitting diode) array, an LCS (liquid crystal shutter) array, or the like for forming an electrostatic latent image on the charged area of the photosensitive drum 10. As shown in FIG. 1, the charged area of the drum 10 is illuminated with a light beam 22 emitted from the optical writing means, and the charges are released from the illuminated zone, indicated by reference numeral 24, so that a potential difference between the illuminated zone and the remaining zone forms an electrostatic latent image (i.e., the illuminated zone 24) on the drum surface.

The toner developing device 14 comprises a vessel 14*a* for holding a developer or toner, and a developing roller 14*b* provided within the vessel 14*a* in such a manner that a portion of the developing roller is exposed therefrom and faces the surface of the photosensitive drum 10. For example, when a two-component developer composed of a toner component (colored fine synthetic resin particles) and a magnetic component (magnetic fine carrier) is used, the developing roller 14*b* is formed as a magnetic roller so that the magnetic carriers with toner particles are magnetically adhered to the magnetic roller surface to form a magnetic brush therearound, and by rotating the magnetic roller 14*b* carrying the magnetic brush, the toner particles are brought to the surface of the photosensitive drum 10 for development of the electrostatic latent image formed thereon. Since the uniform distribution of the positive charges (+) is produced on the drum surface as mentioned above, a two-component developer is prepared so that the toner particles are positively charged by a triboelectrification to the magnetic carriers. During the development process, the toner particles having the positive charges are electrostically adhered to the electrostatic latent image zone, as if the latent image zone or low potential zone is charged with the positive toner particles, whereby the developed image or toner image can be obtained as a visible image. Note, in FIG. 1, the positive toner particles are indicated by a symbol ○.

The transfer charger 16, which may also comprise a corona discharger, forms a part of the toner image transferring device according to the present invention. The transfer charger 16 is arranged to give a negative charge (−) to the paper P introduced into the clearance between the photosensitive drum 10 and the transfer charger 16, as shown in FIG. 1, whereby when the paper P is given a negative charge, the positive toner particles forming the toner image are electrostatically transferred to the paper. The paper P carrying the transferred toner image is then passed through the toner image fixing device 20, which comprises a heat roller 20*a* and a backup roller 20*b*. In particular, when the paper P is passed through the rollers 20*a* and 20*b*, the transferred toner particles are heat-fused by the heat roller 20*a* so that the transferred toner image is heat-fixed to the paper P. Note, in FIG. 1, the fixed toner particles are indicated by reference numeral 26. The residual toner particles not transferred to the paper P are removed from the surface of the photosensitive drum 10 by the cleaner 18, which may comprise a fur brush element 18*a*. The cleaned surface of the drum is illuminated by a lamp (not shown), so as to eliminate the charges therefrom, and is then given a positive charge (+) by the charger 12.

Figure 2:
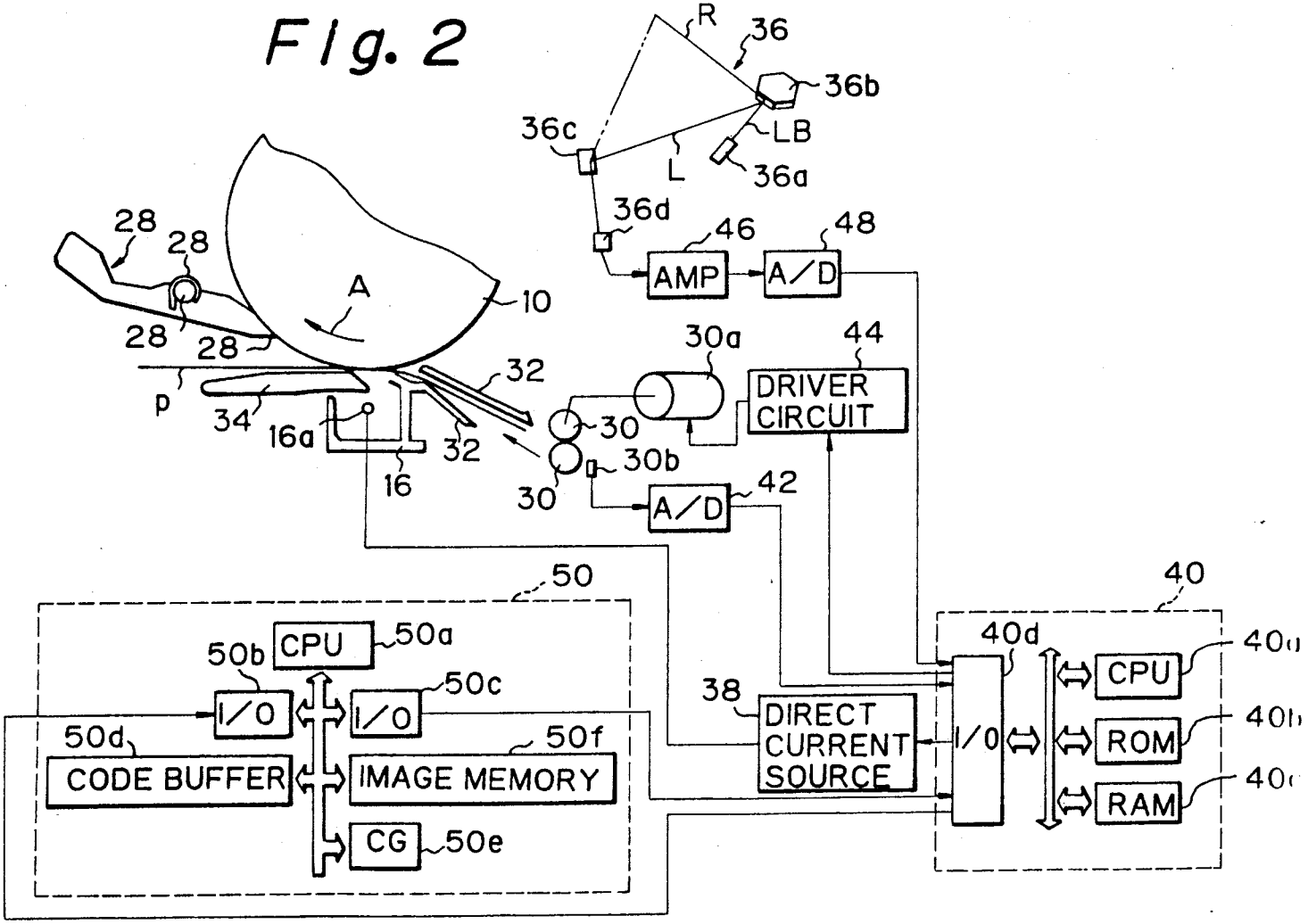
FIG. 2 is a block diagram of a toner image transferring device according to the present invention, which is applied to the electrophotographic printer of FIG. 1.

Referring to FIG. 2, although the electrophotographic printer of FIG. 1 is only partially shown, the toner image transferring device according to the present invention is incorporated therein. As shown in this drawing, the printer includes a pair of nail members 28 (only one illustrated in FIG. 2) which engage with the surface of the photosensitive drum 10 at the side edges thereof to separate the leading edge of the paper therefrom and prevent an entanglement of the paper P with the drum 10. The nail member 28, which may be formed of a suitable hard rubber material, is pivotally mounted to a pin element 28*a*. The nail member 28 is provided with a torsion spring 28*b* which acts on the nail member 28 and the pin element 28*a* so that a nail edge 28*c* of the nail member 28 is resiliently biased against the drum surface.

As shown in FIG. 2, the electrophotographic printer also includes a pair of feed rollers 30 driven by an electric motor 30*a* such as a stepping motor, a servo-motor or the like, whereby the paper P is introduced into the clearance between the photosensitive drum 10 and the transfer charger 16. While the paper P is conveyed from a paper supply station (not shown) toward the feed rollers 30, the motor 30*a* is driven, and when the leading edge portion of the paper P enters between the feed rollers 30, the electric motor 30*a* is once stopped so that the paper P is stopped. This standby condition is detected by a suitable photosensor 30*b* disposed in the vicinity of the feed rollers 30. Namely, the photosensor 30*b* generates a standby-signal when the paper P is stopped. Note, in FIG. 2, reference numeral 32 indicates a pair of guide plate elements by which the paper P is guided when introduced into the clearance between the drum 10 and the charger 16, and reference 34 indicates a guide plate element by which the paper P is guided while passing therethrough.

As shown in FIG. 2, the optical writing means for writing an electrostatic latent image on the surface of the electrophotographic drum 10 is formed as a laser beam scanner 36, which includes a laser beam generator 36*a* such as a semiconductor laser device for emitting a laser beam LB, and a polygon mirror 36*b* for deflecting the laser beam LB from a left position indicated by L to a right position indicated by R, to scan the drum surface with the deflected laser beam. During the scanning operation, the laser beam LB is intermittently emitted on the basis of video data or image data obtained from a word processor, a microcomputer or the like, whereby the electrostatic latent image is formed as a dot image on the drum surface. Note, the dot image is formed from a plurality of dot lines formed in parallel to each other in the scanning direction. The laser beam scanner 36 also includes a reflector element 36*c* for receiving and reflecting the laser beam deflected to the left position L, and a beam sensor 36*d* for detecting the laser beam reflected by the reflector element 36*c*. Namely, the beam sensor 36*d* generates a beam detecting signal when the laser beam LB is deflected to the left position L by the polygon mirror 36*b*.

The toner image transfer device according to the present invention includes an electric source 38 for applying a direct current to a corona wire 16*a* of the transfer charger 16, and a control circuit 40 for carrying out an ON/OFF control of the electric source 38. Note, the control circuit 40 forms a part of the electrophotographic printer mentioned above, and commands the overall operation thereof. The printer control circuit 40 may be constructed by a microcomputer, as shown in FIG. 2, which comprises a central processing unit (CPU) 40*a*, a read-only memory (ROM) 40*b* for storing routines, constants, etc., a random access memory (RAM) 40*c* for storing temporary data, and an input-/output interface (I/O) 40*d*.

As shown in FIG. 2, the photodetector 30*b* is connected to the I/O 40*d* through an analog-to-digital (A/D) converter 42, so that the standby-signal generated by the photodetector 30*b* is fetched as digital datum by the printer control circuit 40. A driver circuit 44 for driving the electric motor 30*a* is also connected to the I/O 40*d*, so that the electric motor 30*a* is commanded by the printer control circuit 40. Furthermore, the beam sensor 36*d* is connected to the I/O 40*d* through an amplifier circuit 46 and an analog-to-digital (A/D) converter 48, so that the beam detecting signal generated by the beam detector 36*d* is fetched as digital datum by the printer control circuit 40.

As shown in FIG. 2, the printer control circuit 40 is connected to a host control circuit 50, which may be incorporated into a word processor, a microcomputer or the like, and which comprises a central processing unit (CPU) 50*a*, first and second input/output interfaces (I/O) 50*b* and 50*c* connected to the I/O 40*d* of the printer control circuit 40, a code buffer 50*d* for temporarily storing character code data successively read from a memory means such as a floppy disk, a character generator 50*e* for converting the character code data into image data, and an image memory 50*f* for temporarily storing the data.

When the printer control circuit 40 fetches the standby-signal generated by the photosensor 30*b*, or when the paper P is standing for the transfer of the toner image thereto, a signal demanding image data to be recorded on the paper P (one page) is output from the printer control circuit 40 to the host control circuit 50. When the host control circuit 50 receives the image data demanding signal, the character code data stored in the buffer 50*d* is converted into the image data by the character generator 50*e*, and is then stored in the image memory 50*f*. When the image data to be recorded on the paper P (one page) is stored in the image memory 50*f*, a signal allowing a writing of the image data on the photosensitive drum 10 is output from the host control circuit 50 to the printer control circuit 40. Whenever the beam detecting signal is generated by the beam sensor 36*d* after the printer control circuit 40 receives the writing-allowing signal from the host control circuit 50, a horizontal synchronizing signal is output from the printer control circuit 40 to the host control circuit 50, and accordingly, the image data corresponding to one dot line of the dot image is output from the image memory 50*f* to the printer control circuit 40, whereby the dot image (electrostatic latent image) can be properly formed on the photosensitive drum 10 in such a way that the dot lines are aligned with each other in the direction perpedicular to the scanning direction. On the other hand, when the beam detecting signal is first generated by the beam sensor 36*d* after the writing-allowing signal is received by the printer control circuit 50, a timing signal is output by the printer control circuit 40 and the electric motor 44 is driven to release the paper P from the standby-condition, whereby the toner image is transferred from the photosensitive drum 10 to the paper at a proper position thereon.

The operation of the toner image transferring device of FIG. 2 will be now explained with reference to FIGS. 3, 4 and 5. The operation may be carried out, for example, under the following conditions:

(1) The photosensitive drum 10 with the amorphous silicone film (a-Si) has a diameter of 120 mm, and is rotated at a peripheral speed of 240 mm/s.

(2) The uniform distribution of positive charges having a potential of +700 V is formed on the photosensitive drum 10, and the electrostatic latent image 24 formed thereon has a potential of about +100 V.

(3) The latent image 24 is developed with the two-component developer, and a developing bias voltage of +450 V is applied to the developing roller 14*b*.

(4) The electric source 38 outputs a direct current of −200 μA to the transfer charger 16, when made ON.

(5) A time of 532 ms passes while the paper P is moved from the standby-position to a position at which the leading edge thereof reaches an inlet of the clearance between the photosensitive drum 10 and the transfer charger 16.

(6) The printer control circuit 40 is arranged so that the electric source 38 is made ON when 172 ms have elapsed from the time at which the leading edge of the paper P reaches the clearance inlet. Namely, when 704 ms have elapsed from the time at which the paper P is released from the standby-condition, the electric source 38 is made ON for the transfer of the toner image to the paper P.

Figure 3:
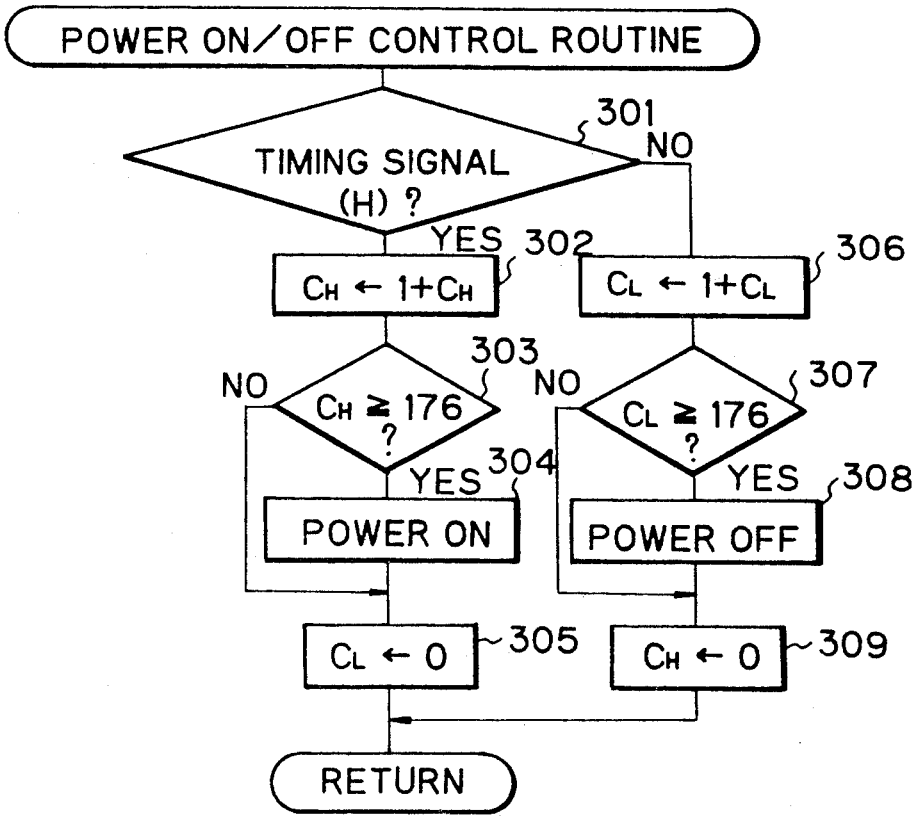
FIG. 3 is a flow chart for explaining an operation of the toner image transferring device of FIG. 2.
Figure 4:
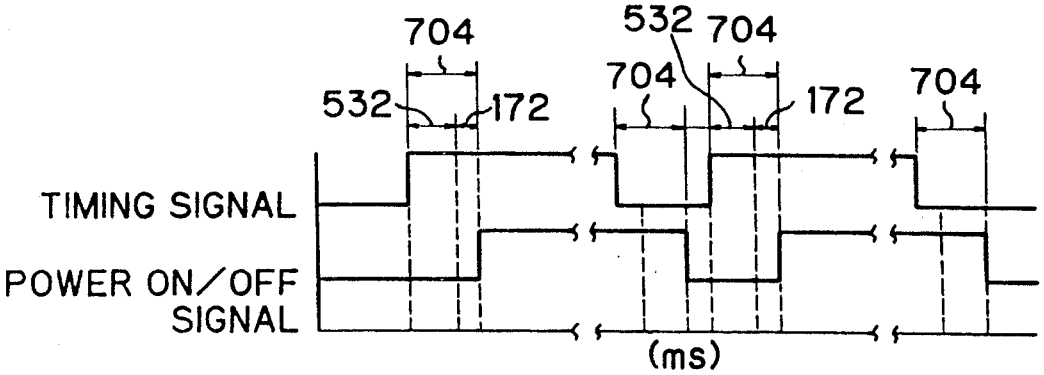
FIG. 4 is a time chart in relation to the flow chart of FIG. 3.
Figure 5:
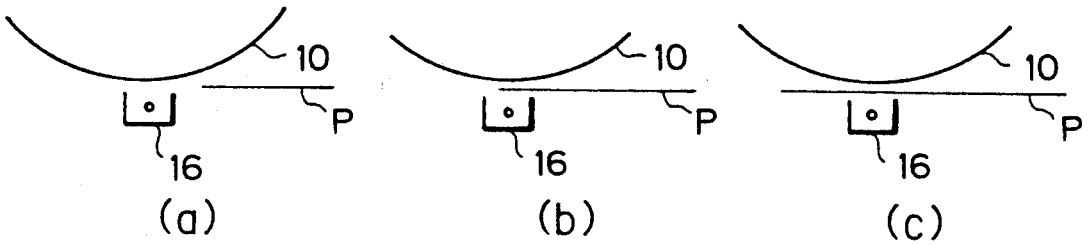
FIGS. 5(*a*), 5(*b*), and 5(*c*) are views showing steps of the operation of the toner image transferring device of FIG. 2.

FIG. 3 shows a routine for the ON/OFF control of the electric source 38 which is executed by interruptions output at intervals of 4 ms, FIG. 4 shows a time chart with relation to the routine of FIG. 3, and FIGS. 5(*a*), 5(*b*) and 5(*c*) are views showing the steps of the operation.

At step 301, it is determined whether the timing signal is high or low; i.e., it is determined whether or not the paper P has been released from the standby-condition. If the timing signal rises, as shown in FIG. 4, i.e., the paper P has been released from the standby-condition, the control proceeds to step 302 in which a counter $C_H$ is incremented by 1. Then, at step 303, it is determined whether or not the counter $C_H$ has counted up 176 (704 ms). If $C_H<176$(704 ms), the control jumps from step 303 to step 304, in which a counter $C_L$ is reset, and then the routine is once completed. Thereafter, the routine is repeatedly executed at intervals of 4 ms, but the counter $C_H$ is only incremented by 1 until the count number thereof reaches 176 (704 ms).

As apparent from the above, when the counter $C_H$ has a count number of 133 (532 ms), the leading edge of the paper P has reached only the inlet of the clearance between the photosensitive drum 10 and the transfer charger 16. Accordingly, when a count number of the counter C is less than 133 (532 ms), the paper P cannot enter the clearance between the drum 10 and the transfer charger 16, as shown in FIG. 5(*a*). At this time, the electric source 38 is made OFF, as shown in FIG. 4. When a count number of the counter $C_H$ exceeds 133 (532 ms), the leading edge portion of the paper P is introduced into the clearance between the drum 10 and the transfer charger 16, to be partially entered therebetween, as shown in FIG. 5(*b*). The electric source 38, however, is still made OFF until the counter $C_H$ has a count number of 176 (704 ms), as shown in FIG. 4.

When the count number of the counter $C_H$ reaches 176 (704 ms) at step 303, the paper P is completely intervened between the photosensitive drum 10 and the transfer charger 16, as shown 5(*c*), and thus the control proceeds from step 303 to step 304, in which the electric source 38 is made ON. Namely, a power ON/OFF signal, which is output from the printer control circuit 40 to the electric source 38, rises as shown in FIG. 4, so that a direct current of $-200\ \mu A$ is applied to the transfer charger 16, whereby the toner image is transferred from the photosensitive drum 10 to the paper P.

When the writing of the electrostatic latent image to be recorded on the paper P (one page) on the photosensitive drum 10 is completed, the timing signal falls as shown in FIG. 4, and when the timing signal becomes low, the control proceeds from step 301 to step 306 in which the counter $C_L$ is incremented by 1. Then, at step 307, it is determined whether or not the counter $C_L$ has a count number of 176 (704 ms). If $C_L<176$ (704 ms), the control jumps from step 307 to step 309 in which the counter $C_H$ is reset. Thereafter, the routine is repeatedly executed at intervals of 4 ms, but the counter $C_L$ is only incremented by 1 until the count number thereof reaches 176 (704 ms).

When the count number of the counter $C_L$ reaches 173 (704 ms), the transfer of the toner image to the paper P can be completed, and thus the control proceeds from step 307 to step 308 in which the power ON/OFF signal falls as shown in FIG. 4, so that the electric source 38 is made OFF.

In the operation as mentioned above, after the leading edge portion (i.e., margin zone) of the paper P is introduced into the clearance between the photosensitive drum 10 and the transfer charger 16, the electric source 38 for the transfer charger 16 is energized so that the leading edge portion of the paper P is not excessively charged by the transfer charger 16. Accordingly, the electrostatic attraction between the paper P and the photosensitive drum 10 can be greatly reduced, and thus the leading edge portion of the paper P can be easily separated from the drum 10 without becoming entangled therewith.

Figure 6:
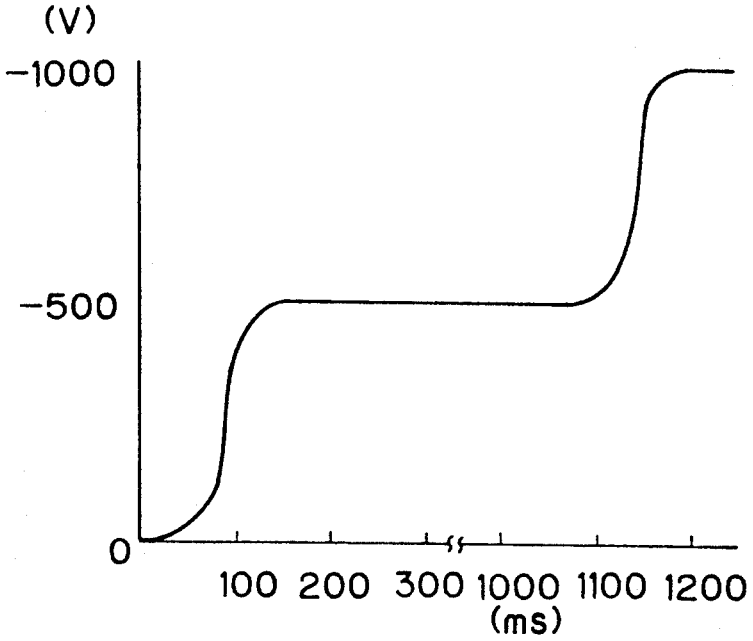
FIG. 6 is a graph showing a distribution of charge of a sheet or paper when using the toner image transferring device of FIG. 2.

When using the toner image transferring device as shown in FIG. 2, an actual measurement of the charge of the paper P was made. For this measurement, a potentiometer was disposed in the vicinity of an outlet of the clearance between the photosensitive drum 10 and the transfer charger 16, whereby a potential of the paper P was measured while the paper P passed through the clearance between the drum 10 and the transfer charger 16. The results are shown in FIG. 6, in which the origin of the abscissa scale and the 1250 ms division thereof correspond to the leading and trailing edges of the paper P, respectively. As apparent from the distribution of charges shown in FIG. 6, an amount of charge held by the leading edge portion of the paper P was very small.

Figure 7:
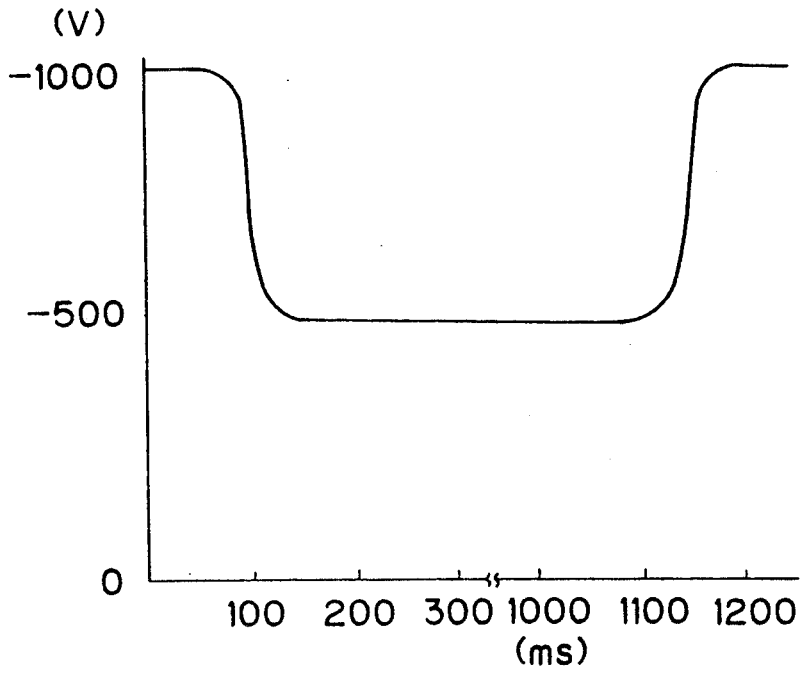
FIG. 7 is a graph showing a distribution of charge of a sheet or paper when using a prior toner image transferring device.

On the contrary, FIG. 7 shows a distribution of charges obtained when using a prior toner image transferring device, wherein the transfer charger is energized before the paper arrives thereat. As apparent from this drawing, a volume of charge held by the leading edge portion of the paper is very large. This is because, as stated hereinbefore, an amount of electric charge fed from the transfer charger to the photosensitive drum is very large when the paper is not intervened therebetween so that, when the leading edge of the paper is introduced into the clearance between the drum and the transfer charger, a portion of the electric charge to be fed to the drum is added to the charge at the leading edge portion of the paper.

Figure 8:
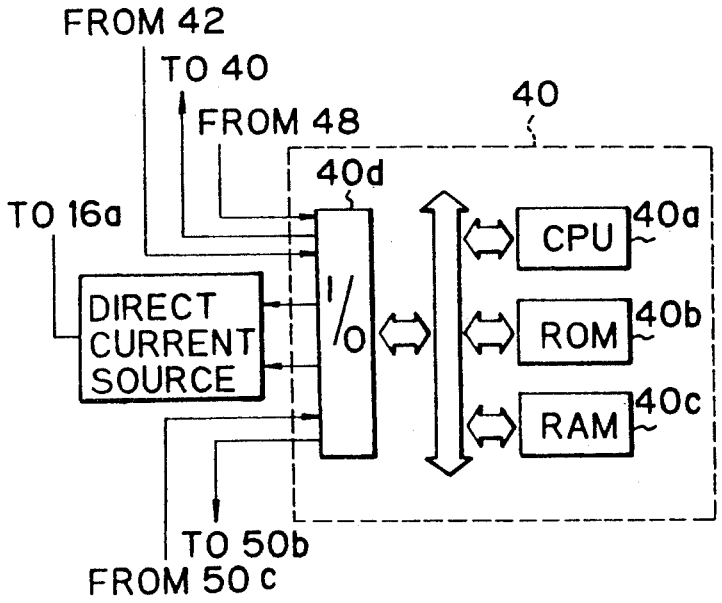
FIG. 8 is a partial block diagram showing a modification of the toner image transferring device of FIG. 2.

FIG. 8 shows a modification of the embodiment shown in FIG. 2, which is substantially identical to the embodiment of FIG. 2 except that another type electric source 38' is substituted for the electric source 38. The electric source 38' is arranged so as to supply two different levels of electric energy to the transfer charger 16, by a power change signal generated in the printer control circuit 40.

The operation of the toner image transferring device of FIG. 8 will be now explained with reference to FIGS. 9 and 10. The operation may be carried out under the same conditions as in in FIG. 2 except that the electric source 38' supplies a direct current of $-100\ \mu A$ or $-200\ \mu A$ to the transfer charger 16.

Figures 9, 9A:
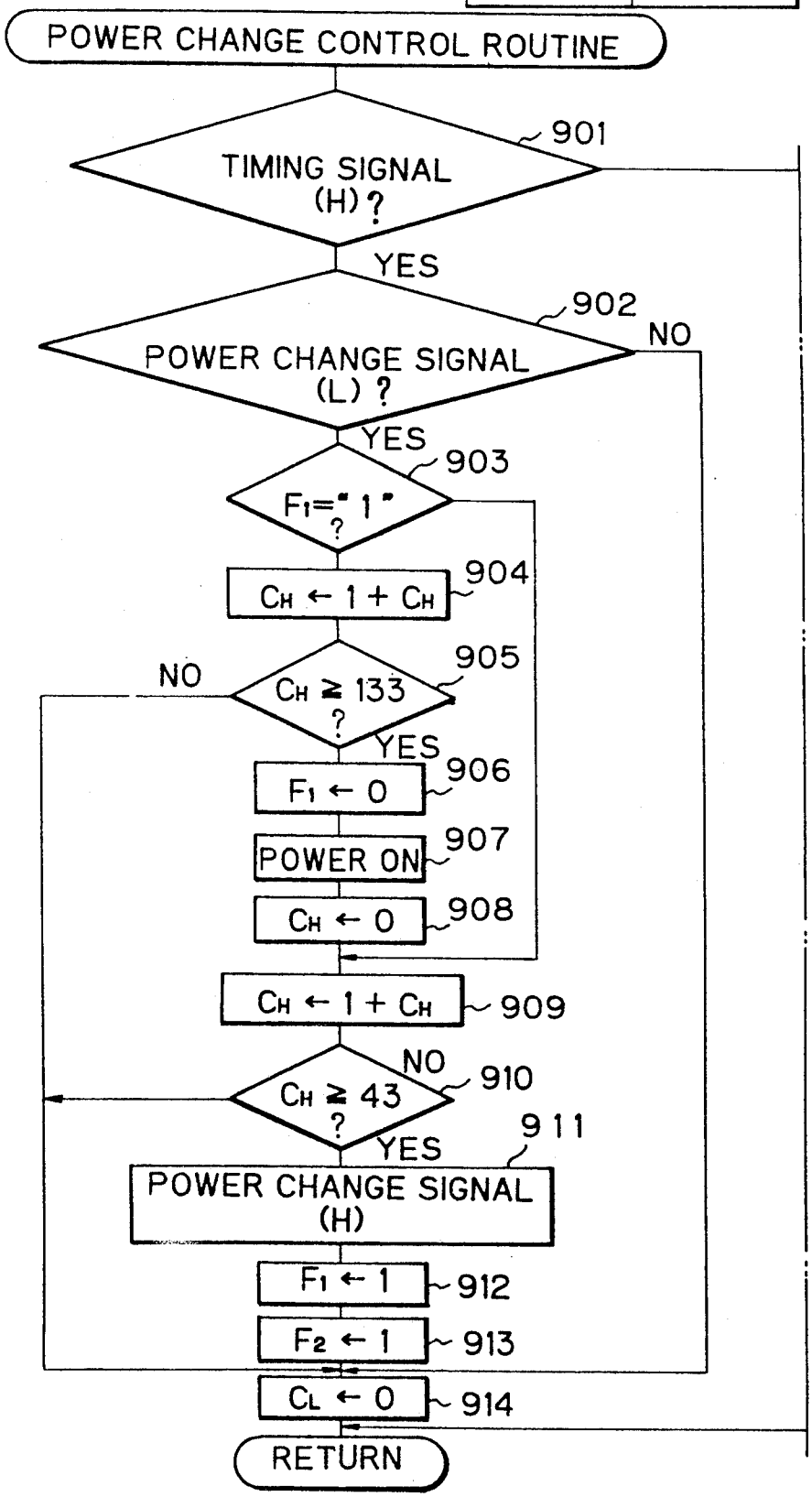
FIG. 9, composed of FIGS. 9*a* and 9*b*, forms a flow chart for explaining an operation of the toner image transferring device of FIG 8.
Figure 9B:
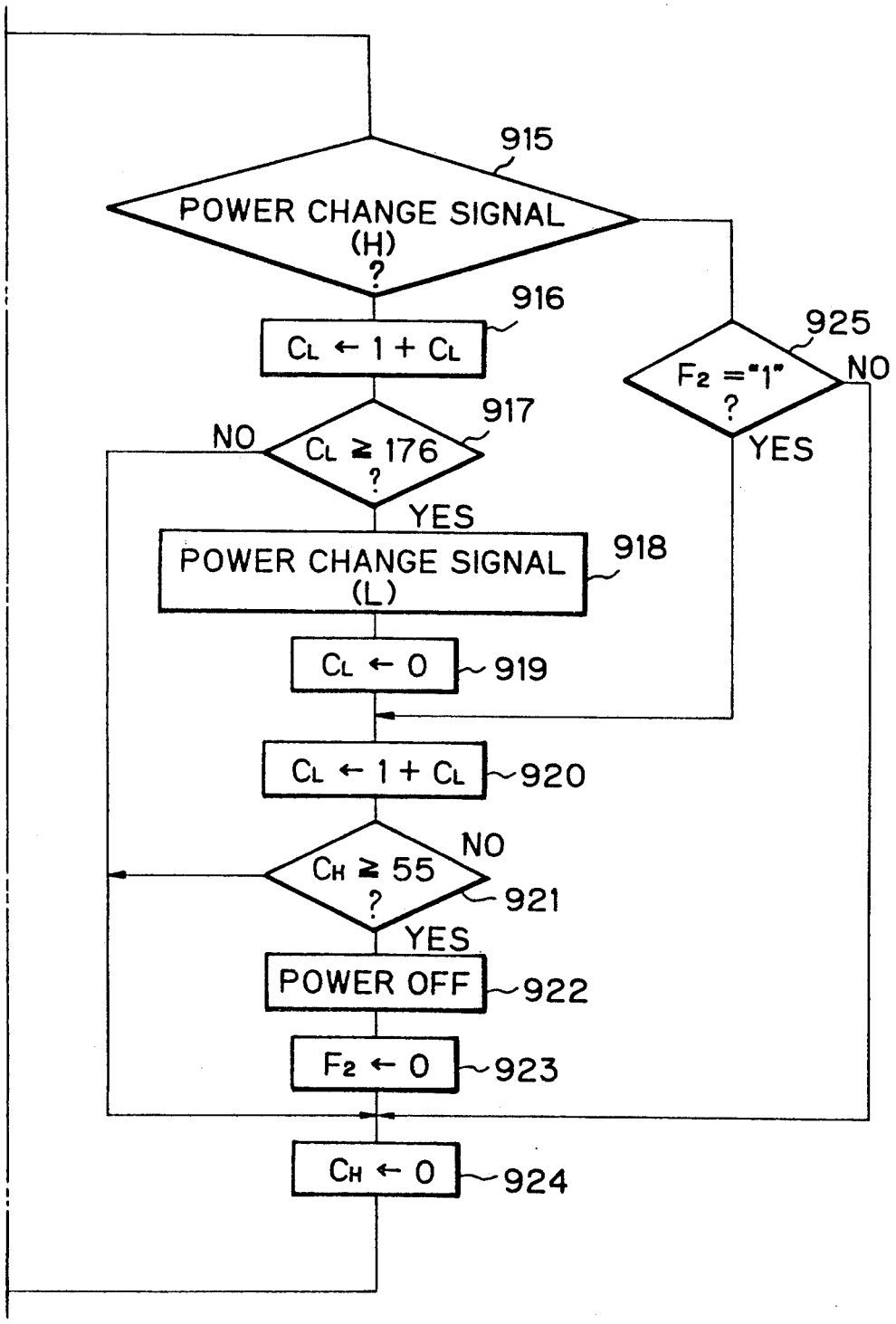
Figure 10:
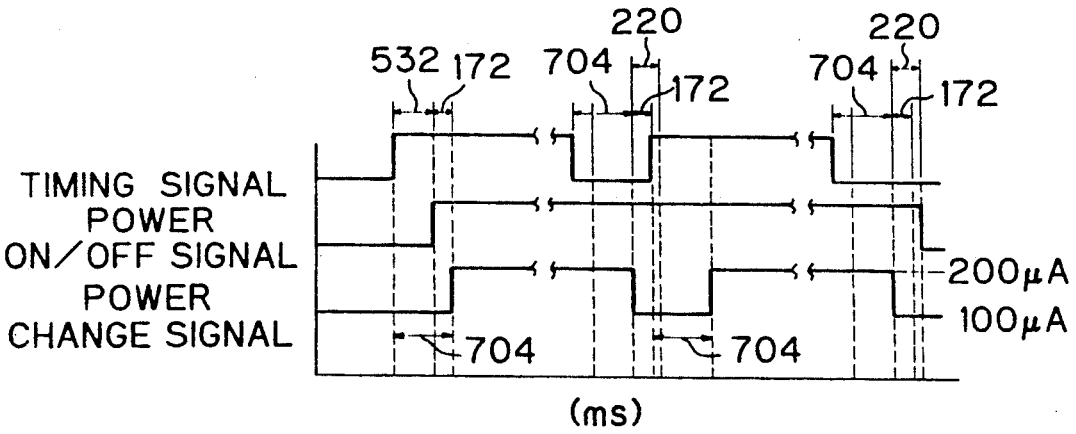
FIG. 10 is a time chart in relation to the flow chart of FIG. 9.

FIG. 9 shows a routine for the output control of the electric source 38' which is executed by interruptions output at intervals of 4 ms, and FIG. 10 shows a time chart with relation to the routine of FIG. 9.

At step 901, it is determined whether the timing signal is high or low; i.e., it is determined whether or not the paper P has been released from the standby-condition. If the timing signal rises, as shown in FIG. 10, i.e., that the paper P has been released from the standby-condition, at step 902 it is determined whether or not the power change signal is low or high. if the power change signal is low, the control proceeds to step 903, in which it is determined whether a flag $F_1$ is "1" or "0". If $F_1=1$, a counter $C_H$ is incremented by 1 at step 904. Then, at step 905, it is determined whether or not the count number of the counter $C_H$ has reached 133 (532 ms). If $C_H<133$ (532 ms), the control jumps from step 905 to step 914, in which a counter $C_L$ is reset, and then the routine is once completed. The routine is repeatedly executed at intervals of 4 ms, but the counter $C_H$ is only incremented by 1 until the count number thereof reaches 133 (532 ms).

At step 905, when a count number of the counter $C_H$ is 133 (532 ms), i.e., when the leading edge of the paper P has reached the inlet of the clearance between the photosensitive drum 10 and the transfer charger 16, the control proceeds to step 906 in which the flag $F_1$ is made "0". Then, at step 907, the power ON/OFF signal rises, as shown in FIG. 10, so that the electric source 38' for the transfer charger 16 is made ON, whereby a direct current of $-100$ μA is applied from the electric source 38' to the transfer charger 16, because the power change signal is low.

When the electric source 38' is made ON, the control proceeds to step 908 in which the counter $C_H$ is cleared. At step 909, the counter $C_H$ is incremented by 1, and then the control proceeds to step 910 in which it is determined whether or not the count number of the counter $C_H$ is 43 (172 ms). If $C_H<43$ (172 ms), the control jumps from step 910 to step 914 in which the counter $C_L$ is cleared, and then the routine is once completed. Thereafter, the routine is repeatedly executed at intervals of 4 ms, but the counter $C_H$ is only incremented by 1 until the count number thereof reaches 43 (172 ms), because the control merely jumps from step 903 to step 909. Note, the flag $F_1$ is "0".

When a count number of the counter $C_H$ reaches 43 (172 ms), i.e., when the paper P is completely intervened between the photosensitive drum 10 and the transfer charger 16, the control proceeds from step 910 to step 911, in which the power change signal becomes high, as shown in FIG. 10, so that the direct current applied from the electric source 38' to the transfer charger 16 is changed from $-100$ μA to $-200$ μA. Then, at step 912, the flag $F_1$ is made "1", and at step 913, a flag $F_2$ is made "1". After the counter $C_L$ is cleared at step 914, the routine is once completed, and thereafter, the routine is repeatedly executed at intervals of 4 ms but the status is maintained as is as long as the timing signal is high, because the control merely jumps from step 902 to 914. Note, the power change signal is high.

When the writing of the electrostatic latent image to be recorded on the paper P (one page) on the photosensitive drum 10 is completed, the timing signal falls as shown in FIG. 10. When the timing signal becomes low, the control proceeds from step 901 to step 915 in which it is determined whether or not the power change signal is high or low. At this time, since the power change signal is high, the control proceeds to step 916 in which the counter $C_L$ is incremented by 1. Then, at step 917, it is determined whether or not the count number of the counter $C_L$ has reached 176 (704 ms). If $C_L<176$ (704 ms), the control jumps from step 917 to step 924, in which a counter $C_H$ is reset, and then the routine is once completed. The routine is repeatedly executed at intervals of 4 ms, but the counter $C_L$ is only incremented by 1 until the count number of the counter $C_L$ reaches 176 (704 ms).

When the count number of the counter $C_L$ reaches 173 (704 ms), the transfer of the toner image to the paper P can be completed, and thus the control proceeds from step 917 to step 918 in which the power change signal falls, as shown in FIG. 10, so that the direct current applied from the electric source 38' to the transfer charger 16 is changed from $-200$ μA to $-100$ μA.

Then, at step 919, the counter $C_L$ is reset, and the control proceeds to step 920 in which the counter $C_L$ is imcremented by 1. At step 921, it is determined whether or not the count number of the counter $C_L$ has reached 55 (220 ms). If $C_L<55$ (220 ms), the control jumps from step 921 to step 924, in which the counter $C_H$ is cleared, and then the routine is once completed. Thereafter, the routine is repeatedly executed at intervals of 4 ms, but the counter $C_L$ is only incremented by 1 until the count number thereof reaches 55 (220 ms), because the control merely jumps from step 915 to step 920 through step 925. Note, the power change signal is low, and the flag $F_2$ is "1".

If the timing signal again becomes high until the count number of the counter $C_L$ reaches 55 (220 ms), i.e., if the timing signal rises after 172 ms has elapsed from a time when the power change signal falls, as shown in FIG. 10, the operation as mentioned above is repeated so that the transfer of the toner image to the next paper is carried out. On the other hand, if the timing signal does not become high until a count number of the counter $C_L$ reaches 55 (220 ms), the control proceeds from step 921 to step 922, in which the power ON/OFF signal falls, as shown in FIG. 10 (left side), and then at step 923, the flag $F_2$ is made "0". After the counter $C_H$ is cleared, the routine is once completed. Thereafter, the routine is repeatedly executed at intervals of 4 ms, but the status is maintained as is as long as the timing signal is low, because the control proceeds from step 901 to step 915, and then jumps from step 925 to step 924. Namely, the transfer charger 16 cannot be energized until the timing signal rises.

In the operation as mentioned above, after the leading edge portion (namely, margin zone) of the paper P enters the clearance between the photosensitive drum 10 and the transfer charger 16, the electric source 38 for the transfer charger 16 is energized at the high level ($-200$ μA) so that the leading edge portion of the paper P is not excessively charged by the transfer charger 16. Accordingly, the electrostatic attraction between the paper P and the photosensitive drum 10 can be greatly reduced, and thus the leading edge portion of the paper P can be easily separated from the drum 10 without becoming entangled therewith.

Figure 11:
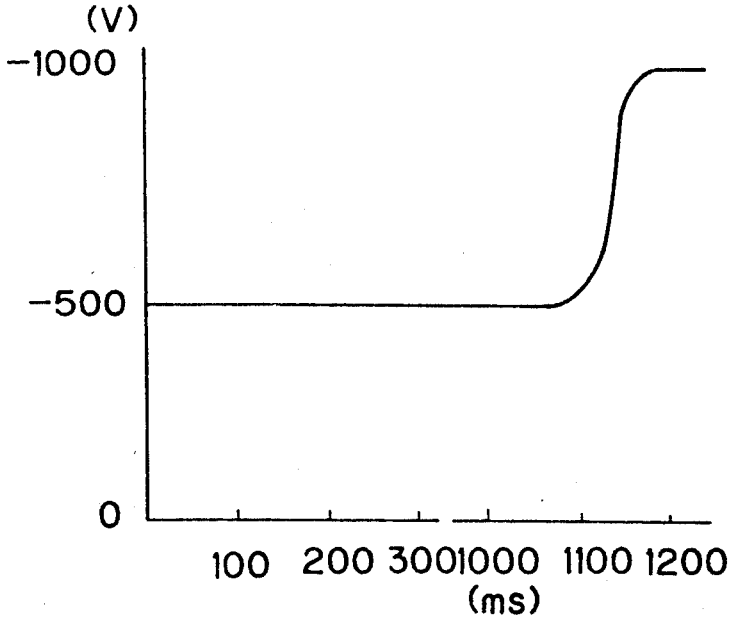
FIG. 11 is a graph showing a distribution of charge of a sheet or paper when using the prior toner image transferring device of FIG. 8.

When using the toner image transferring device as shown in FIG. 8, an actual measurement of the charge held by the paper P was made. The measurement was carried out in the same manner as in the embodiment of FIG. 2, and the results are shown in FIG. 11. As apparent from the distribution of charges shown in FIG. 11, the leading edge portion of the paper P was not excessively charged.

In the embodiments shown in FIGS. 2 and 8, although the electric sources 38 and 38' comprise a direct current source, a direct current voltage source may be substituted therefor. Also, although the nail members 28 are used to separate the leading edge of the paper P from the photosensitive drum 10, they may be omitted, if desired, since the separation can be properly carried out only by preventing an excessive charging of the leading edge portion of the paper P.

Figures 12A, 12B:
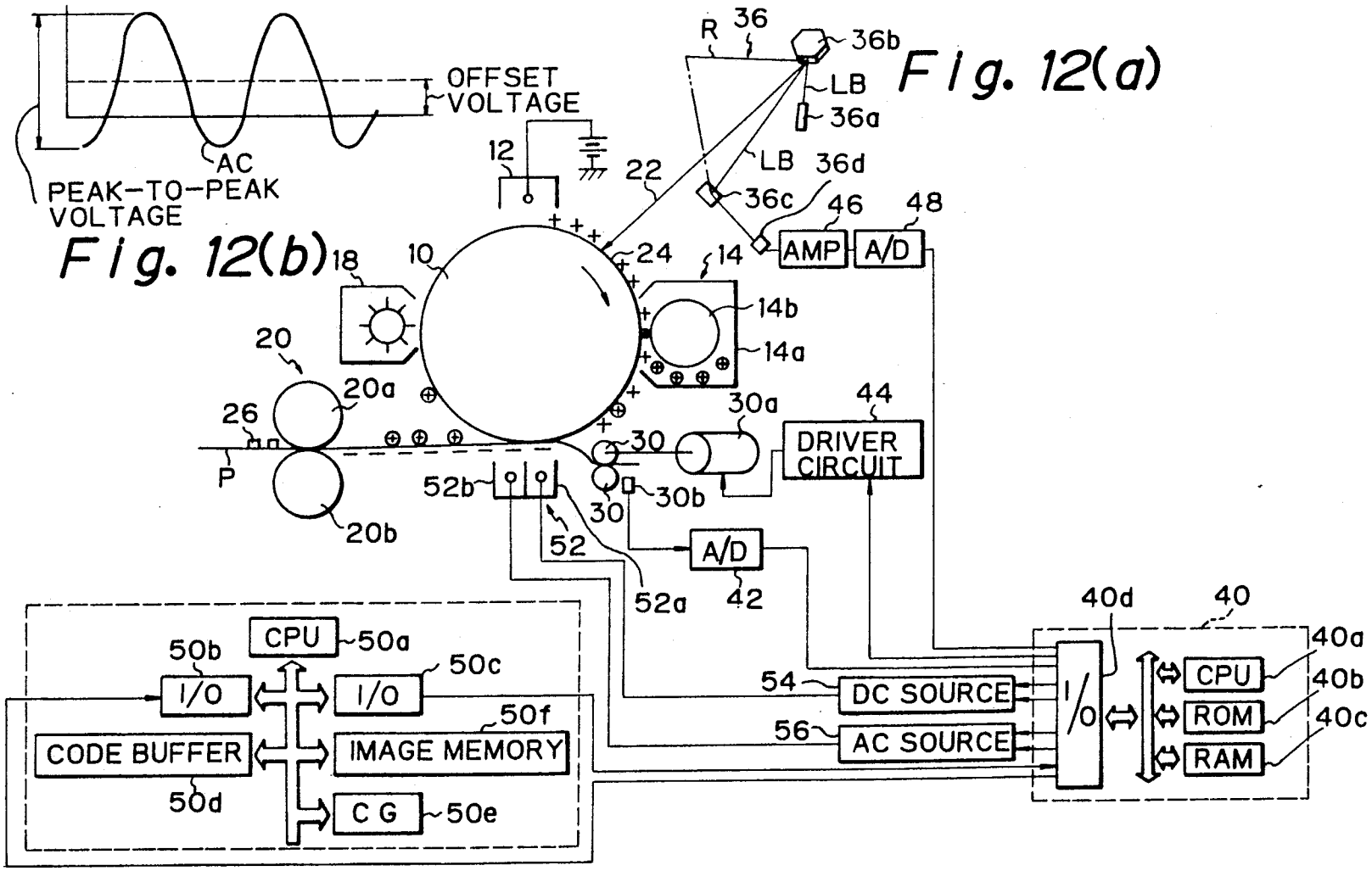
FIG. 12(*a*) is a block diagram of another type toner image transferring device according to the present invention, which is applied to the electrophotographic printer of FIG. 1.

FIG. 12(*a*) shows another embodiment of the toner image transferring device according to the present invention. This embodiment is substantially identical to that of FIG. 2, except that a transfer charger assembly 52 is substituted for the transfer charger 38, and that a DC source 54 and an AC source 56 are used for the transfer charger assembly 52. The transfer charger assembly 52 includes a transfer charger 52*a* and an AC charge eleminator 52*b* intergrated as one body, and the DC source 54 and the AC source 56 supply electric energy to the transfer charger 52*a* and the AC charge eliminator 52*b*, respectively. The DC source 54 is the same type as the electric source 38'; i.e., the DC source 54 is arranged so as to supply the electric energy at two different levels to the transfer charger 52*a*, by a DC power change signal generated in the printer control circuit 40. The AC source 56 is also arranged so as to supply the electric energy at two different levels to the AC charge eliminator 52*b*, by an AC power change signal generated in the printer control circuit 40.

The operation of the toner image transferring device of FIG. 12(*a*) will be now explained with reference to FIGS. 13, 14, and 15. The operation may be carried out under the same conditions as in FIG. 2, except for the following conditions:

(1) The DC source 54 supplies a direct current of $-100\ \mu A$ or $-200\ \mu A$ to the transfer charger 52*a*.

(2) The AC source 56 supplies an alternate current voltage (peak-to-peak) of 12 KV biased with an offset voltage of 100 V or an alternate current voltage (peak-to-peak) of 12 KV biased with an offset voltage of 750 V. Note, as shown in FIG. 12(*b*), the peak-to-peak voltage is defined as an amplitude width of the AC voltage, and the offset voltage is defined as a voltage for shifting the AC voltage along the potential axis.

(3) A time of 532 ms elapses while the paper P is moved from the standby-position to a position at which the leading edge thereof reaches an inlet of the clearance between the photosensitive drum 10 and the transfer charger 16, and a time of 172 ms elapses while the leading edge of the paper P is moved from the clearance inlet to an outlet thereof.

Figures 13, 13A:
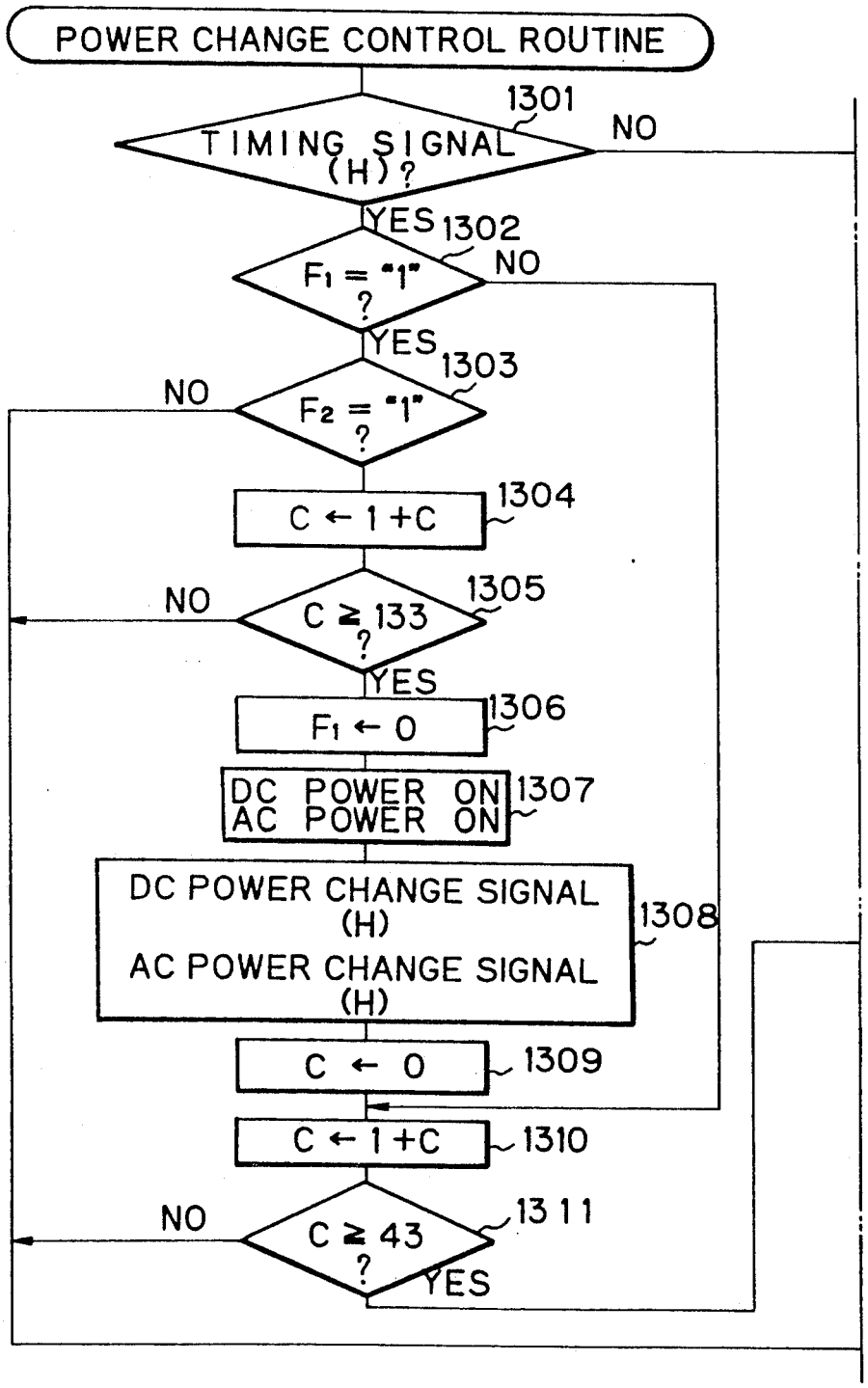
FIG. 13, composed of FIGS. 13A and 13B, forms a flow chart for explaining an operation of the toner image transferring device of FIG. 12.
Figure 13B:
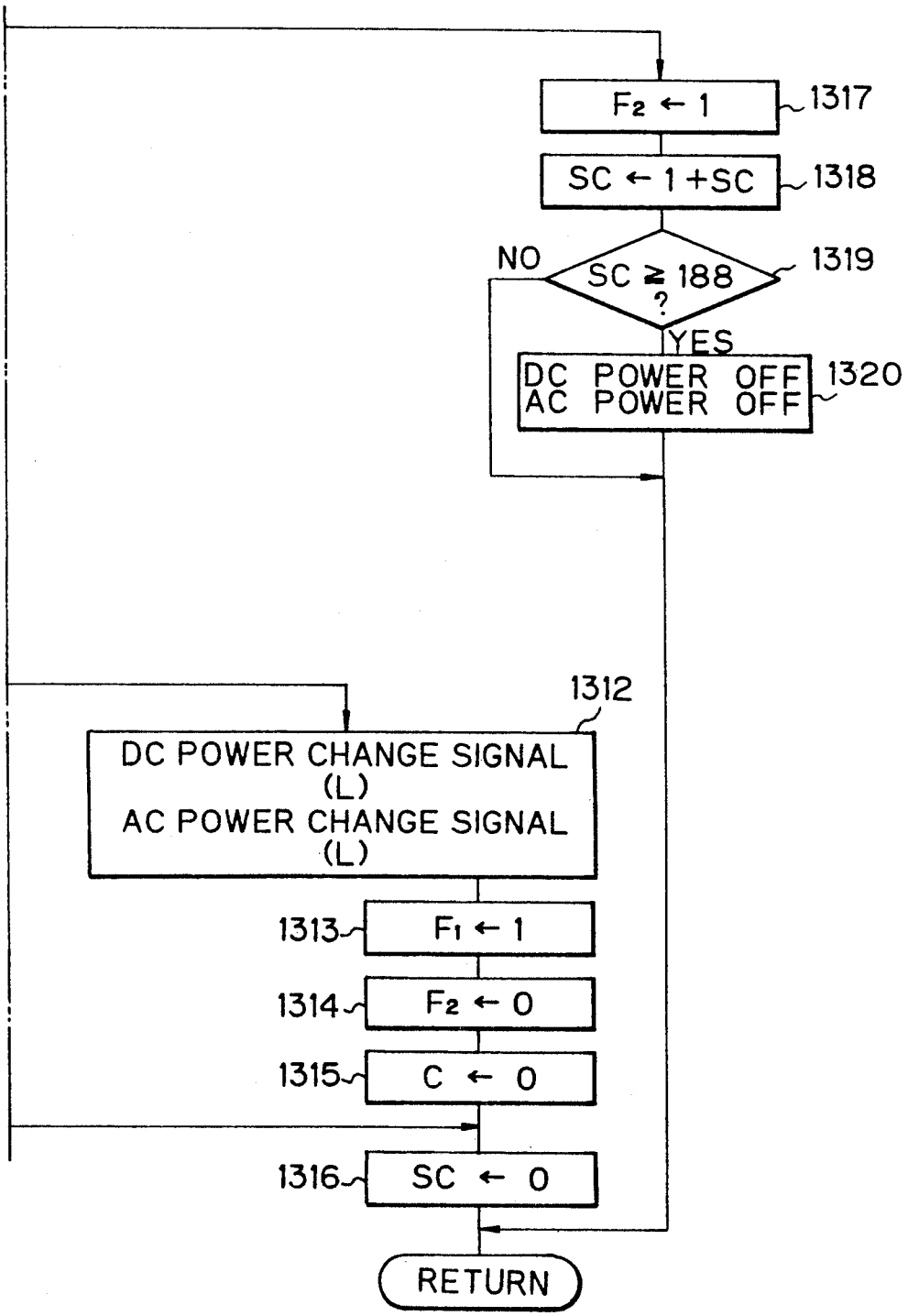
Figure 14:
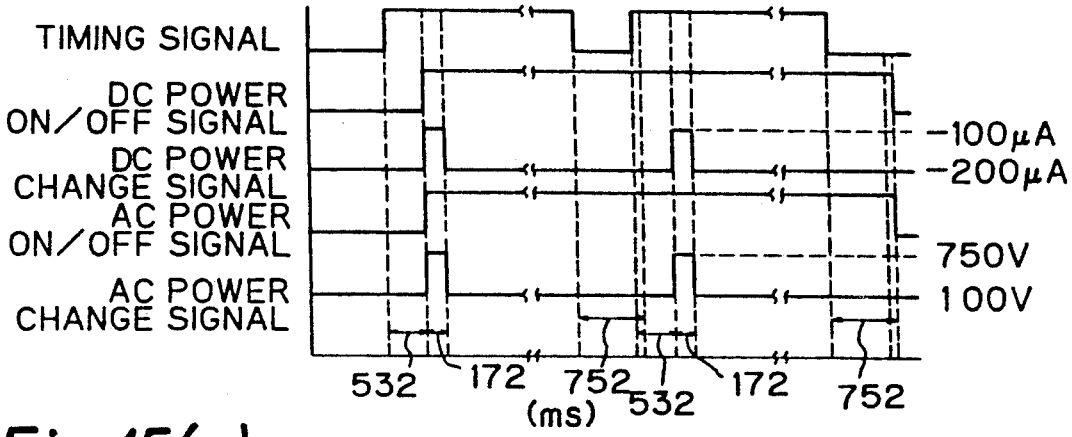
FIG. 14 is a time chart in relation to the flow chart of FIG. 13.
Figure 15A:
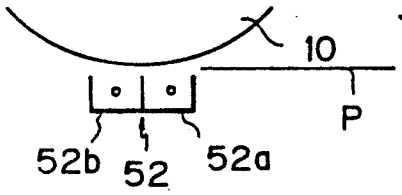
FIGS. 15(*a*), 15(*b*), and 15(*c*) are views showing steps of the operation of the toner image transferring device of FIG. 12.
Figure 15B:
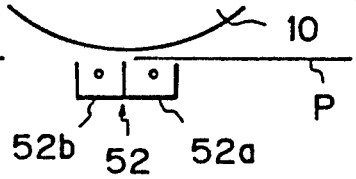
Figure 15C:
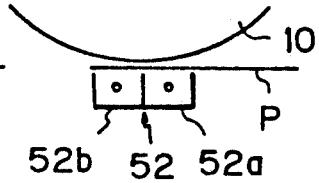

FIG. 13 shows a routine for the power change control of the DC and AC sources 54 and 56 which is executed by interruptions output at intervals of 4 ms, FIG.14 shows a time chart with relation to the routine of FIG. 13, and FIGS. 15(*a*), 15(*b*) and 15(*c*) are views showing the steps of the operation.

At step 1301, it is determined whether the timing signal is high or low; i.e., it is determined whether or not the paper P has been released from the standby-condition. If the timing signal rises, as shown in FIG. 14, showing that the paper P has been released from the standby-condition, the control proceeds to step 1302 in which it is determined whether a flag $F_1$ is "1" or "0". If $F_1$="1", the control proceeds to step 1303, in which it is determined whether a flag $F_2$ "1" or "0" . If $F_2$="1", the control proceeds to step 1304 in which a counter C is incremented by 1, and then at step 1305, it is determined whether or not the count number of the counter C has reached 133 (532 ms). If C <133 (532 ms), the control jumps from step 1305 to step 1316, in which a counter SC is reset, and then the routine is once completed. Thereafter, the routine is repeatedly executed at intervals of 4 ms, but the counter C is only incremented by 1 until the count number thereof reaches 133 (532 ms).

At step 1305, when the count number of the counter C reaches 133 (532 ms), i.e., when the leading edge of the paper P has reached the inlet of the clearance between the photosensitive drum 10 and the transfer charger assembly 52 as shown in FIG. 15(*a*), the control proceeds to step 1306 in which the flag $F_1$ is made "0". Then, at step 1307, the DC and AC power ON/OFF signals rise to make the DC and AC sources 54 and 56 ON, and at step 1308, the DC and AC power change signals rise, so that the direct current of $-100\ \mu A$ and the alternate current voltage of 12 KV (offset voltage of 750 V) are applied by the DC and AC sources 54 and 56 to the transfer charger 52*a* and the AC charge eliminator 52*b*, respectively, as shown in FIG. 14.

At step 1309, the counter C is reset, and then the control proceeds to step 1310 in which the counter C is incremented by 1. At step 1311, it is determined whether or not the count number of the counter C has reached 43 (172 ms). If C <43 (172 ms), the control jumps from step 1311 to step 1316 in which the counter SC is reset, and then the routine is once completed. Thereafter, the routine is repeatedly executed at a time of 4 ms, but the counter C is only incremented by 1 until the count number thereof reaches 43 (172 ms).

When the count number of the counter C reaches 43 (172 ms), i.e., when the leading edge of the paper P has reached the outlet of the clearance between the photosensitive drum 10 and the transfer charger assembly 52, as shown 15(*c*), the control proceeds from step 1311 to step 1312, in which the DC and AC power change signals fall so that the direct current of $-100\ \mu A$ and the alternate current voltage of 12 KV (offset voltage of 750 V) applied to the transfer charger 52*a* and the AC charge eliminator 52*b* are changed to the direct current of $-200\ \mu A$ and the alternate current voltage of 12 KV (offset voltage of 100 V), respectively, as shown in FIG. 14, whereby the transfer of the toner image to the paper P is started. When a count number of the counter C is less than 43 (172 ms), the paper P is only partially intervened between the photosensitive drum 10 and the transfer charger assembly 52, as shown in FIG. 15(*b*). In this case, the DC and AC power change signals are kept high so that the leading edge portion of the paper is not excessively charged.

Then, at step 1313, the flag $F_1$ is made "1", and at step 1314, the flag $F_2$ is made "0". Then successively, at step 1315 the counter C is reset, and at step 1316 the counter SC is cleared, whereby the routine is once completed. Thereafter, the routine is repeatedly executed at intervals of 4 ms, but the status is maintained as is as long as the timing is high, because the control merely jumps from step 1303 to 1316. Note, the flag $F_1$ is "1", and the flag $F_2$ is "0".

When the writing of the electrostatic latent image to be recorded on the paper P (one page) is completed, the timing signal falls as shown in FIG. 14.

When the timing signal becomes low, the control proceeds to step 1301 to step 1317, in which the flag $F_2$ is made "1". At step 1318, the counter SC is incremented by 1, and then at step 1319, it is determined whether or not the count number of the counter SC has reached 188 (752 ms). If SC <188 (752 ms), the routine is once completed. Thereafter, the routine is repeatedly executed at intervals of 4 ms, but the counter C is only incremented by 1 until the count number thereof reaches 188 (752 ms).

If the timing signal again becomes high until the count number of the counter SC reaches 188 (752 ms), as shown in FIG. 14, the operation as mentioned above is repeated so that the transfer of the toner image to the next paper is carried out. On the other hand, if the timing signal does not become high until the count number of the counter $C_L$ reaches 188 (752 ms), the control proceeds from step 1318 to step 1320, in which the DC and AC power ON/OFF signals fall, as shown in FIG. 14 (left side), and then the routine is once completed. Thereafter, the routine is repeatedly executed at intervals of 4 ms, but the status is maintained as is as long as the timing signal is low. Namely, the transfer charger 52*a* and the AC charge eliminator 52*b* cannot be energized until the timing signal becomes high.

Figure 16:
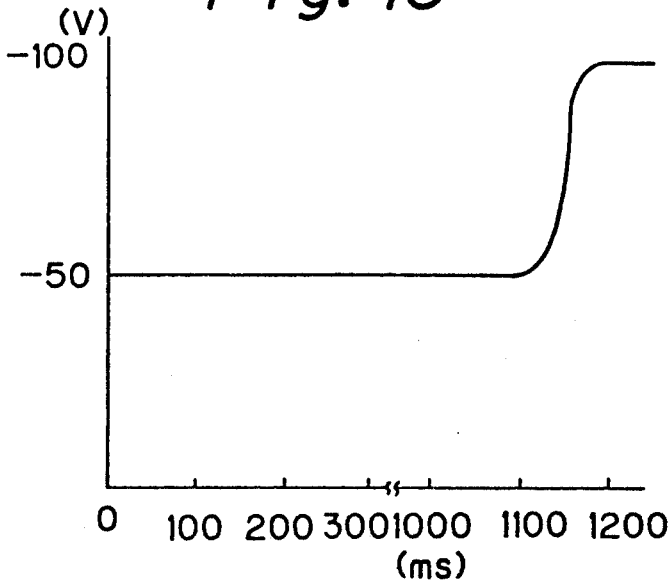
FIG. 16 is a graph showing a distribution of charge of a sheet or paper when using the toner image transferring device of FIG. 12.

When using the toner image transferring device as shown in FIG. 12(*a*), an actual measurement of the charge of the paper P was made. The measurement was carried out in the same manner as in the embodiment of FIG. 2, and the results are shown in FIG. 16. As apparent from the distribution of charges shown in FIG. 11, the leading edge portion of the paper P was not excessively charged.

Figure 17:
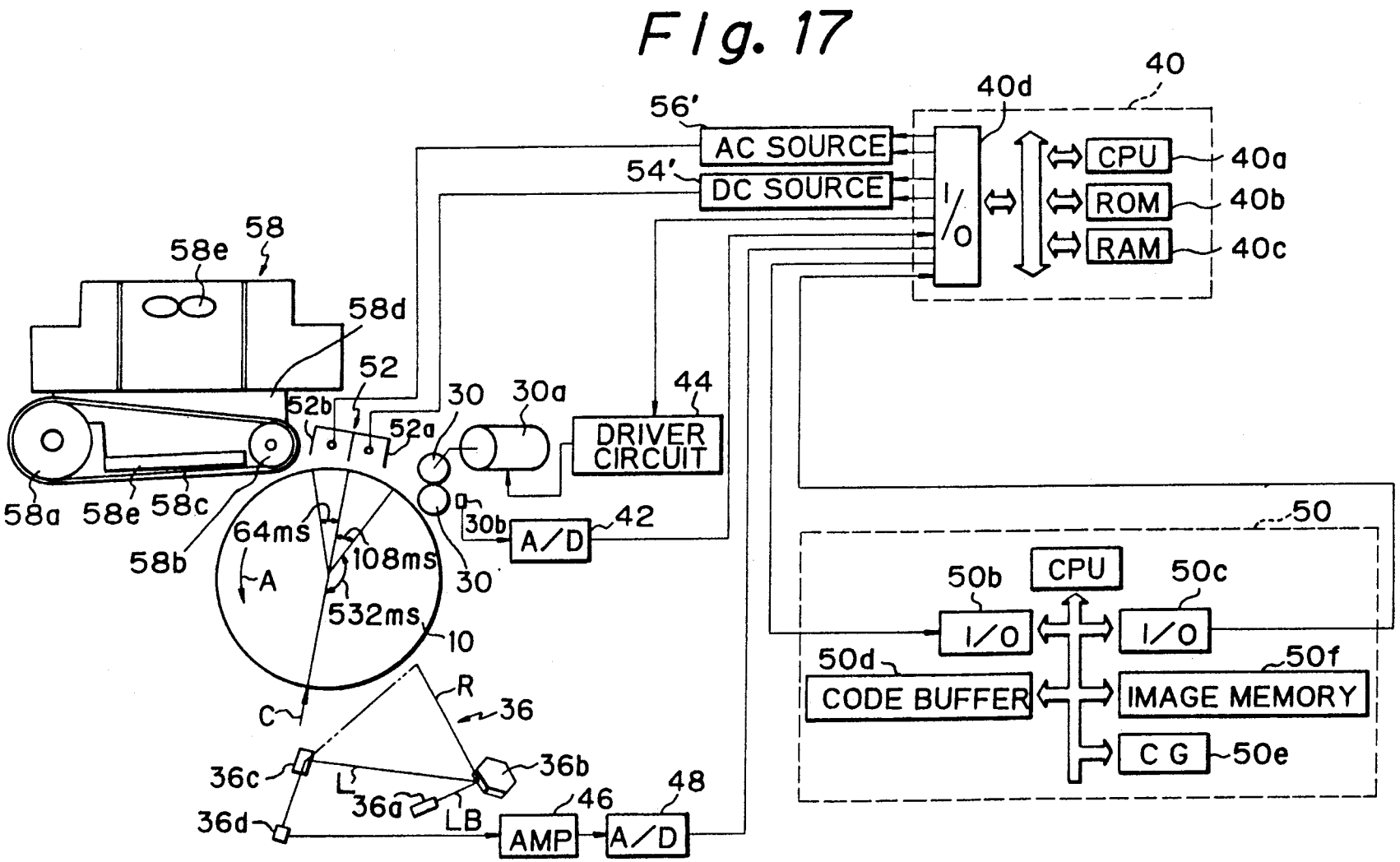
FIG. 17 is a block diagram of a modification of the toner image transferring device of FIG. 12(*a*), which is applied to another type electrophotographic printer.

FIG. 17 shows a modification of the embodiment as shown in FIG. 12(*a*), but the toner image transferring device of FIG. 17 is incorporated into another type electrophotographic printer. The electrophotographic printer as shown in FIG. 17 features an air suction endless belt conveyer assembly 58 including a pair of pulleys 58*a* and 58*b*, an endless belt element 58*c* entrained over the pulleys 58*a* and 58*b*, and a suction box member 58*d* associated with the endless belt element 58*c*. The pulley 58*a* is driven by an electric motor (not shown) in the clockwise direction in FIG. 17, and the pulley 58*b* acts as a driven pulley. The endless belt element 58*c* has a plurality of perforations formed therein, which are disposed in the running direction of the endless belt element 58*c*. The suction box member 58*d* is provided with a fan element 58*e* for drawing a vacuum therefrom, and an air suction port member 58*d* having an elongated suction port, which is in slidable contact with an inner surface of the endless belt element 58*c*, whereby the paper leaving the clearance between the photosensitive drum 10 and the transfer charger assembly 52 is sucked up against the endless belt element 58*c*, and it then conveyed to the toner image fixing station (not shown).

In FIG. 17, a location on the photosensitive drum 10 at which an electrostatic latent image is written by the scanning laser beam LB emitted from the laser beam scanner 36 is indicated by an arrow C. By rotation of the drum 10, the location is moved via the toner developing device (not shown) toward the transfer charger assembly 52. In the printer of FIG. 17, a time of 532 ms elapses while the location indicated by the arrow C is moved from the position at which the latent image is written to a first position at which the location is 15 ms short of an inlet of the clearance between the drum 10 and the transfer charger assembly 52. Also, a time of 108 ms elapses while the location is moved from the first position to a second position defined by a boundary between the transfer charger 52*a* and the AC charger eliminator 52*b*. Furthermore, a time of 64 ms elapses while the location is moved from the second position to a third position defined by an outlet of the clearance between the drum 10 and the transfer charger assembly 52.

In the embodiment of the toner image transferring device shown in FIG. 17, the transfer charger 52*a* and the AC charger eliminator 52*b* are energized by a DC source 54' and an AC source 56' which are substantially identical to the transfer charger 54 and the AC charger eliminator 56 in that they are arranged so as to supply electric energy at two different levels to the transfer charger 52*a* and the AC charger eliminator 52*b*.

The operation of the toner image transferring device of FIG. 17 will be now explained with reference to FIGS. 18, 19 and 20. The operation may be carried out under the same conditions as in FIG. 12(*a*), except for the following:

(1) The DC source 54' supplies a direct current of $-100\ \mu A$ or $-200\ \mu A$ to the transfer charger 54'.

(2) The AC source 56' supplies an alternate current voltage (peak-to-peak) of 12 KV biased with an offset voltage of 110 V or an alternate current voltage (peak-to-peak) of 14 KV biased with an offset voltage of 750 V.

(3) A time of 532 ms passes while the paper P is moved from the standby-position to a position at which the leading edge thereof is 15 mm short of the inlet of the clearance between the drum 10 and the assembly 52. Then, while the paper P is moved to a position at which the leading edge thereof reaches the boundary between the transfer charger 52*a* and the AC charger eliminator 52*b*, a time of 108 ms passes. Then successively, while the paper P is moved to the outlet of the clearance between the drum 10 and the assembly 52, a time of 64 ms passes. Namely, the movement of the paper P is synchronized with the rotation of the drum 10.

Figures 18, 18A:
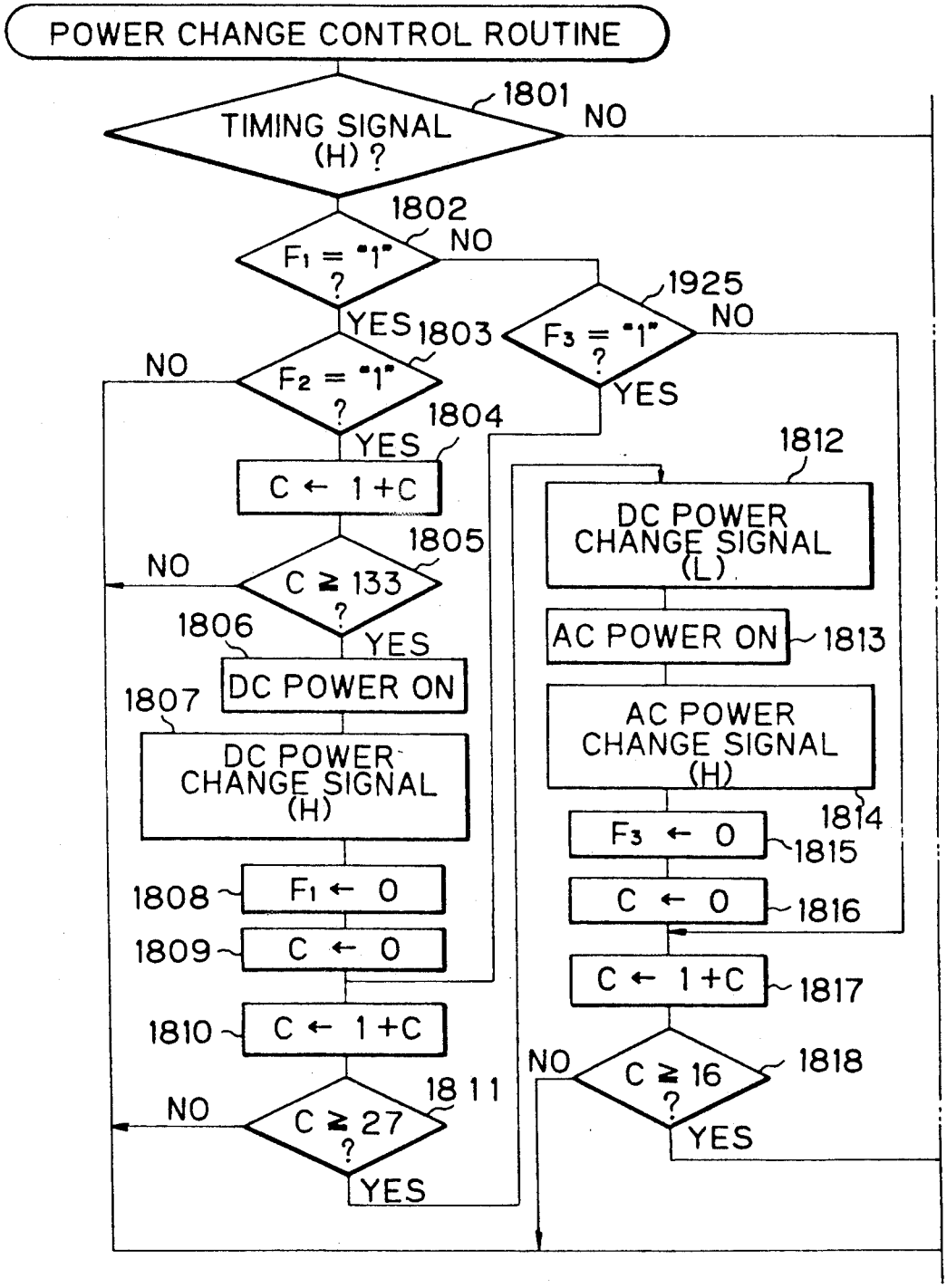
FIG. 18, composed of FIGS. 18A and 18B, forms is a flow chart for explaining an operation of the toner image transferring device of FIG. 17.
Figure 18B:
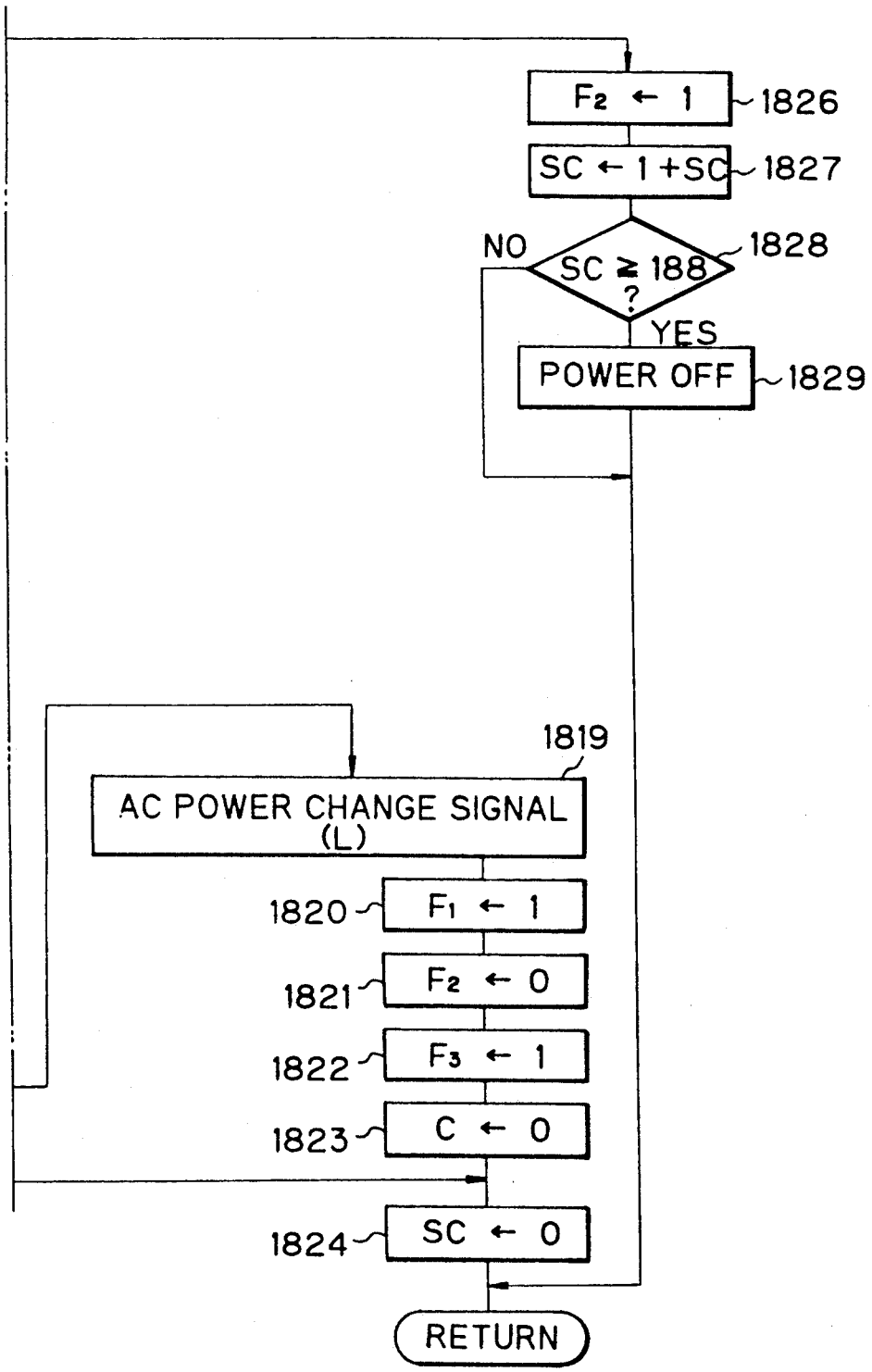
Figure 19:
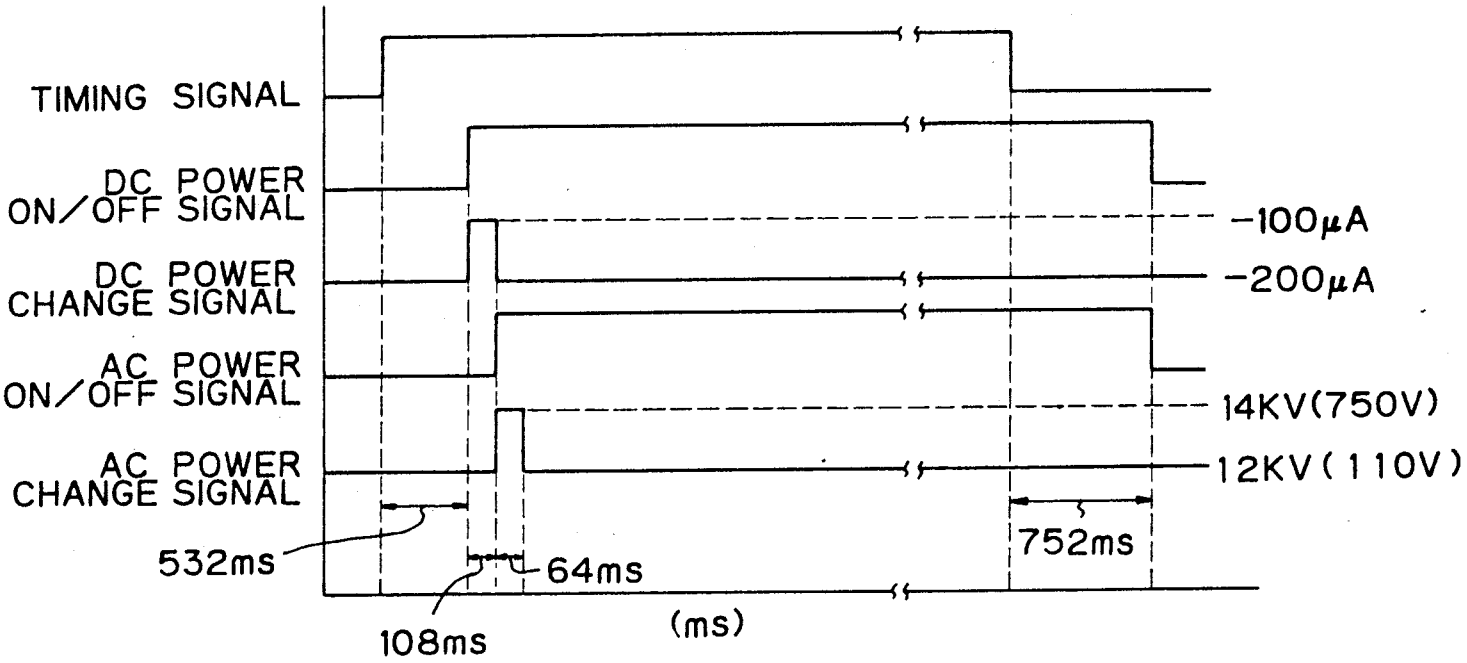
FIG. 19 is a time chart in relation to the flow chart of FIG. 18.

FIG. 18 shows a routine for the power change control of the DC and AC sources 54' and 56' which is executed by interruptions output at intervals of 4 ms, FIG. 19 shows a time chart with relation to the routine of FIG. 18, and FIGS. 20(*a*), 20(*b*) and 20(*c*) are views showing the steps of the operation.

At step 1801, it is determined whether the timing signal is high or low; i.e., it is determined whether or not the paper P has been released from the standby-condition. If the timing signal rises, as shown in FIG. 14, showing that the paper P has been released from the standby-condition, the control proceeds to step 1802 in which it is determined whether a flag $F_1$ is "1" or "0". If $F_1$="1", the control proceeds to step 1803, in which it is determined whether a flag $F_2$ is "1" or "0". If $F_2$="1", the control proceeds to step 1804 in which a counter C is incremented by 1, and then at step 1805, it is determined whether or not the count number of the counter C has reached 133 (532 ms). If $C<133$ (532 ms), the control jumps from step 1805 to step 1824, in which a counter SC is reset, and then the routine is once completed. Thereafter, the routine is repeatedly executed at intervals of 4 ms, but the counter C is only incremented by 1 until the count number thereof reaches 133 (532 ms).

At step 1805, when the count number of the counter C reaches 133 (532 ms), i.e., when the paper P has been moved from the standby-position to the position at which the leading edge thereof is 15 mm short of the inlet of the clearance between the photosensitive drum 10 and the transfer charger assembly 52 as shown in FIG. 19(*a*), the control proceeds to step 1806 in which the DC power ON/OFF signal rises to make the DC source 54' ON, and at step 1807, the DC power change signals rise, so that the direct current of $-100\ \mu A$ is applied by the DC sources 54' to the transfer charger 52*a*, as shown in FIG. 20.

At step 1808, the flag $F_1$ is made "0", and then at step 1809, the counter C is reset. The control proceeds to step 1810 in which the counter is incremented by 1, and then at step 1911, it is determined whether or not the count number of the counter C has reached 27 (108 ms). If C<27 (108 ms), the control jumps from step 1811 to step 1824 in which the counter SC is reset, and then the routine is once completed. Thereafter, the routine is repeatedly executed at a time of 4 ms, but the counter C is only incremented by 1 until the count number thereof reaches 27 (108 ms). Note, the flag $F_1$ is "0", and a flag $F_3$ is "1" at step 1825.

At step 1811, when the count number of the counter C reaches 27 (108 ms), i.e., when the leading edge of the paper P has reached the boundary between the transfer charger 52*a* and the AC charger eliminator 52*b* as shown in FIG. 20(*b*), the control proceeds to step 1812 in which the DC power change signal falls as shown in FIG. 19, so that the direct current of −100 μA applied to the transfer charger 52*a* is changed to the direct current of −200 μA. Then, at step 1813, the AC power ON/OFF signal rises to make the AC source 56' ON, and at step 1814, the AC power change signal rises as shown in FIG. 19, so that the alternate current voltage of 14 KV (offset voltage of 750 V) is applied to the AC charger eliminator 52*b*, as shown in FIG. 19.

At step 1815, the flag $F_3$ is made "0", and then at step 1316, the counter C is reset. The control proceeds to step 1817 in which the counter is incremented by 1, and then at step 1818, it is determined whether or not the count number of the counter C has reached 16 (64 ms). If C<16 (64 ms), the control jumps from step 1818 to step 1824 in which the counter SC is reset, and then the routine is once completed. Thereafter, the routine is repeatedly executed at a time of 4 ms, but the counter C is only incremented by 1 until the count number thereof reaches 16 (64 ms). Note, the flags $F_1$ and $F_3$ are "0".

At step 1818, when the count number of the counter C reaches 16 (64 ms), i.e., when the leading edge of the paper P has reached the outlet of the clearance between the drum 10 and the transfer charger assembly 52 as shown in FIG. 20(*c*), the control proceeds to step 1819 in which the AC power change signal falls as shown in FIG. 19, so that the alternate current voltage of 14 KV (offset voltage of 750 V) applied to the AC charger eliminator 52*b* is changed to the alternate current voltage of 12 KV (offset voltage of 110 V).

Then, at step 1820 the flag $F_1$ is made "1", at step 1821 the flag $F_2$ is made "0", and at step 1822 the flag $F_3$ is made "1". Then successively, at step 1823 the counter C is reset, at step 1824 the counter SC is cleared, and then the routine is once completed. Thereafter, the routine is repeatedly executed at intervals of 4 ms, but the status is maintained as is as long as the timing is high, because the control merely jumps from step 1803 to 1824. Note, the flag $F_1$ is "1", and the flag $F_2$ is "0".

When the writing of the electrostatic latent image to be recorded on the paper P (one page) is completed, the timing signal falls as shown in FIG. 19.

When the timing signal becomes low, the control proceeds to step 1801 to step 1826, in which the flag $F_2$ is made "1". At step 1827, the counter SC is incremented by 1, and then at step 1828, it is determined whether or not the cont number of the counter SC has reached 188 (752 ms). If SC<188 (752 ms), the routine is once completed. Thereafter, the routine is repeatedly executed at intervals of 4 ms, but the counter C is only incremented by 1 until the count number thereof reaches 188 (752 ms).

If the timing signal again becomes high until the count number of the counter SC reaches 188 (752 ms), the operation as mentioned above is repeated so that the transfer of the toner image to the next paper is carried out. On the other hand, if the timing signal does not become high until the count number of the counter $C_L$ reaches 188 (752 ms), the control proceeds from step 1828 to step 1829, in which the DC and AC power ON/OFF signals fall, as shown in FIG. 19, and then the routine is once completed. Thereafter, the routine is repeatedly executed at intervals of 4 ms, but the status is maintained as is as long as the timing signal is low. Namely, the transfer charger 52*a* and the AC charge eliminator 52*b* cannot be energized until the timing signal becomes high.

When using the toner image transferring device as shown in FIG. 17, the leading edge portion of the paper P was not excessively charged, as the proceeding embodiments. Accordingly, it is possible to easily separate the paper P only by using the air suction endless belt conveyor assembly 58.

Figure 21A:
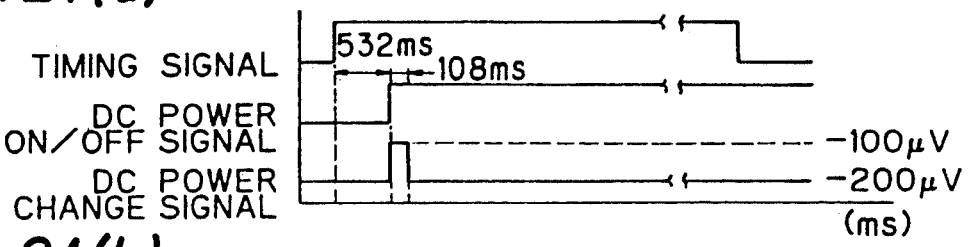
FIGS. 21(*a*), 21(*b*), 21(*c*), 21(*d*), 21(*e*), and 21(*f*) are time charts showing various control parameters selected for the operation of the toner image transferring device of FIG. 17.
Figure 21B:
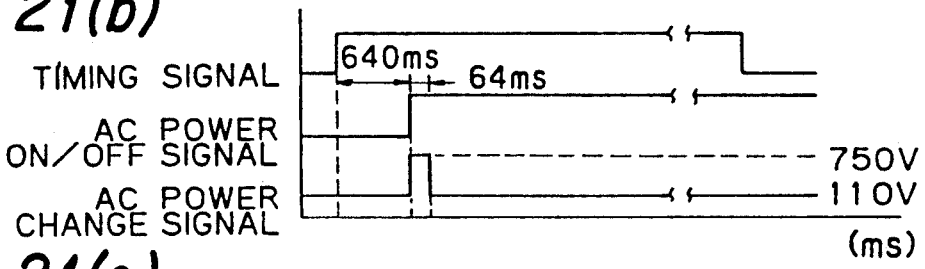
Figure 21C:
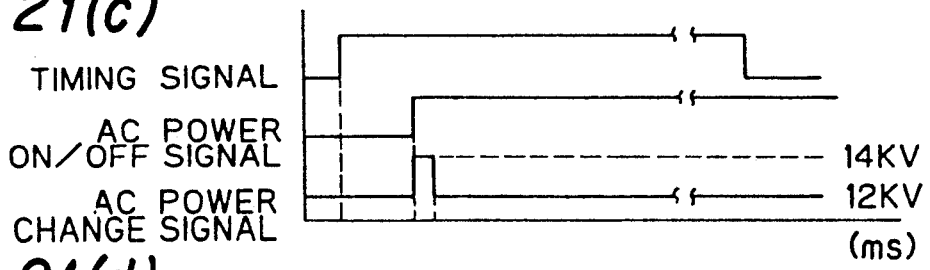
Figure 21D:
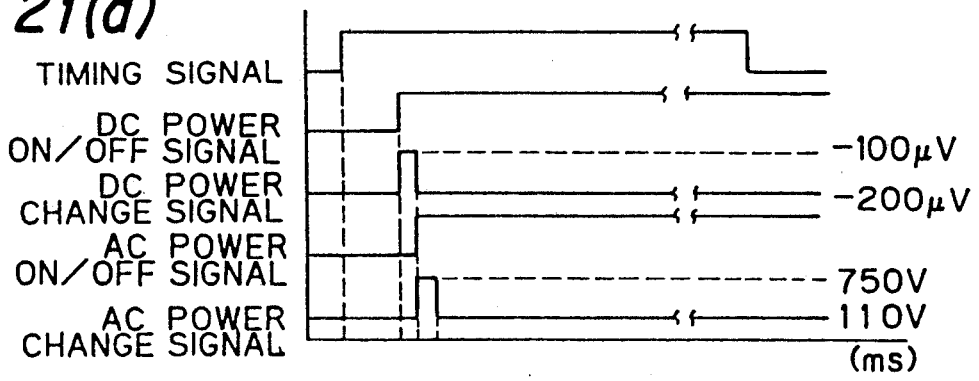
Figure 21:
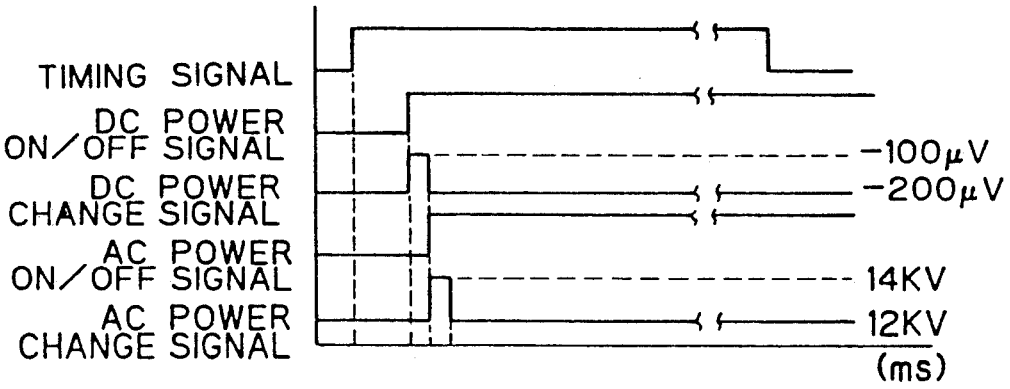
Figure 21F:
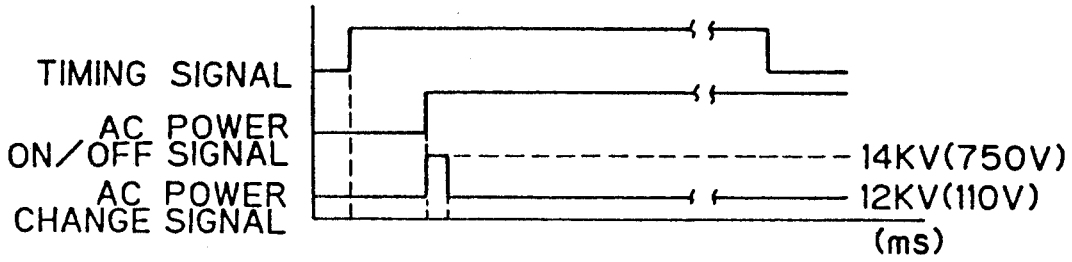

In the embodiment of FIG. 17, although all of the direct current, the peak-to-peak voltage, and the offset voltage are used as control parameters, it should be understood that the control can be carried out by using at least one of these control parameters, as shown in FIGS. 21(*a*) to 21(*f*).

In the embodiments of FIGS. 12(*a*) and 17, although the DC sources 54 and 54' comprise a direct current source, a direct current voltage source may be substituted therefor.

In all of the embodiments mentioned above, although the timing signal based on the beam detecting signal is used to synchronize the movement of the paper with the rotation of the drum, another signal may be utilized therefor.

Finally, it will be understood by those skilled in the art that the foregoing description is of preferred embodiments of the present invention, and that various changes and modifications can be made without departing from the spirit and scope thereof.

We claim:

1. A toner image transferring device for electrostatically transferring a charged toner image electrostatically held by a toner image carrying body to a sheet or paper, said toner image transfer device comprising:

transfer charger means disposed in the vicinity of said toner image carrying body to form a clearance therebetween for feeding an electric charge to the sheet or paper while said sheet or paper is passed therethrough;

electric source means for supplying an electric energy to said transfer charger means to thereby give the sheet or paper an electric charge having a polarity opposite to that of the charge of the toner image; and means for controlling an electric energy output from said electric source means to said transfer charger means in such a manner that said transfer charger means gives the sheet or paper a first amount of electric charge necessary for the transfer of the toner image when the sheet or paper is completely intervened between said toner image carrying body and said transfer charger means during the passage of the sheet or paper through the clearance therebetween, and that said transfer charger means gives the sheet or paper a second amount of electric charge when the leading edge of the sheet or paper is intervened between said toner image carrying body and said transfer charger means during the passage of the sheet or paper through said clearance therebetween, so that a leading edge zone of the sheet or paper has a charge value, resulting from said second amount of electric charge, which is substantially equal to that of the sheet or paper resulting from said first amount of electric charge.

2. A toner image transferring device as set forth in claim 1, wherein said toner image carrying body comprises a photosensitive drum which is rotated to bring the toner image to said transfer charger means, and a means is provided for synchronizing the movement of the sheet or paper with the rotation of said photosensitive drum to transfer the toner image to the sheet or paper at a proper position thereon.

3. A toner image transferring device as set forth in claim 1, wherein said transfer charger means comprises a corona discharger, and said electric source means comprises a direct current source.

4. A toner image transferring device for electrostatically transferring a charged toner image electrostatically held by a toner image carrying body to a sheet or paper, said toner image transfer device comprising:

transfer charger means disposed in a vicinity of said toner image carrying body to form a clearance therebetween for feeding an electric charge to the sheet or paper while the sheet or paper is passed therethrough;

alternate current charger eliminator means disposed adjacent to an outlet of said clearance from which the sheet or paper is discharged, for eliminating a first amount of electric charge from the sheet or paper when the sheet or paper leaves said clearance;

first electric source means for supplying an electric energy to said transfer charger means to give the sheet or paper an electric charge having a polarity opposite to that of the charge of the toner image;

second electric source means for supplying an electric energy to said alternate current charger eliminator means to eliminate the first amount of electric charge from the sheet or paper when leaving said clearance, to prevent a return of the transferred toner image from the sheet or paper to said toner image carrying body; and means for controlling an electric energy output from said first electric source means to said transfer charger means in such a manner that said transfer charger means gives the sheet or paper a first amount of electric charge necessary for the transfer of the toner image when the sheet or paper is completely intervened between said toner image carrying body and said transfer charger means during the passage of the sheet or paper through the clearance therebetween, and that said transfer charger means gives the sheet or paper a second amount of electric charge when the leading edge of the sheet or paper is intervened between said toner image carrying body and said transfer charger means during the passage of the sheet or paper through said clearance therebetween, so that a leading edge zone of the sheet or paper has a charge value, resulting from said second amount of electric charge, which is substantially equal to that of the sheet or paper resulting from said first amount of electric charge.

5. A toner image transferring device as set forth in claim 4, wherein said toner image carrying body comprises a photosensitive drum which is rotated to bring the toner image to said transfer charger means, and a means is provided for synchronizing the movement of the sheet or paper with the rotation of said photosensitive drum to transfer the toner image to the sheet or paper at a proper position thereon.

6. A toner image transferring device as set forth in claim 4, wherein said means for controlling the electric energy output from said second electric source means to said alternate current charger eliminator means utilizes at least one of a peak-to-peak voltage and an offset voltage as a control parameter.

* * * * *